US009192950B2

(12) United States Patent
Carleton et al.

(10) Patent No.: US 9,192,950 B2
(45) Date of Patent: Nov. 24, 2015

(54) SPRAYER FOR A FLUID DELIVERY SYSTEM

(75) Inventors: Christopher W. Carleton, Chaska, MN (US); James J. Handzel, Golden Valley, MN (US); Joseph W. Kieffer, Chanhassen, MN (US); Richard P. Anderson, Cedar Lake Township, MN (US); Christopher J. Sulzer, St. Louis Park, MN (US)

(73) Assignee: WAGNER SPRAY TECH CORPORATION, Plymouth, MN (US)

( * ) Notice: Subject to any disclaimer, the term of this patent is extended or adjusted under 35 U.S.C. 154(b) by 879 days.

(21) Appl. No.: 12/622,952

(22) Filed: Nov. 20, 2009

(65) Prior Publication Data

US 2011/0121103 A1 May 26, 2011

(51) Int. Cl.

| | |
|---|---|
| ***B05B 7/02*** | (2006.01) |
| ***B05B 7/06*** | (2006.01) |
| ***B05B 7/00*** | (2006.01) |
| ***B05B 7/08*** | (2006.01) |
| ***B05B 7/12*** | (2006.01) |
| ***B05B 7/24*** | (2006.01) |
| *B05B 15/06* | (2006.01) |

(52) U.S. Cl.

CPC ..... *B05B 7/062* (2013.01); *B05B 7/0081* (2013.01); *B05B 7/083* (2013.01); *B05B 7/0815* (2013.01); *B05B 7/1209* (2013.01); *B05B 7/1218* (2013.01); *B05B 7/2405* (2013.01); *B05B 7/2478* (2013.01); *B05B 15/061* (2013.01)

(58) Field of Classification Search

CPC .... B05B 7/062; B05B 7/2478; B05B 7/2405; B05B 7/1218; B05B 7/083; B05B 7/0815; B05B 7/0081

USPC ..... 239/525, 526, 300, 301, 46, 345, 376, 239/377, 379; 285/91

See application file for complete search history.

(56) References Cited

U.S. PATENT DOCUMENTS 1,698,945 A * 1/1929 Driscoll ..... 239/301
1,849,300 A * 3/1932 Jenkins ..... 239/301

(Continued)

FOREIGN PATENT DOCUMENTS

CN 1902002 A 1/2007
CN 101300081 A 11/2008

(Continued)

OTHER PUBLICATIONS

PCT/US2010/055051 Communication Relating to the Results of the Partial International Search dated Feb. 14, 2011. 2 pages.

(Continued)

*Primary Examiner* — Jason Boeckmann

(74) *Attorney, Agent, or Firm* — Christopher J. Volkmann; Kelly, Holt & Christenson, PLLC

(57) ABSTRACT

The present disclosure generally relates to a sprayer for a fluid delivery system. In one example, a sprayer for a fluid delivery system is provided. The sprayer includes a main body having a handle and a trigger. The sprayer also includes a spray head having a fluid input for receiving fluid material and a fluid output for spraying the fluid material. The spray head is removably couplable to the main body by rotating the spray head with respect to the main body to engage a connection component of the spray head to a corresponding connection component of the main body. The sprayer also includes a spray head locking mechanism on the main body that extends to engage a portion of the spray head.

3 Claims, 21 Drawing Sheets

(56) References Cited

U.S. PATENT DOCUMENTS

| | | | | |
|---|---|---|---|---|
| 2,497,625 | A | 8/1944 | Norwick | |
| 3,236,459 | A * | 2/1966 | McRitchie | 239/416 |
| 4,560,109 | A | 12/1985 | Teruyuki et al. | |
| 4,817,872 | A * | 4/1989 | Mattson | 239/300 |
| 4,958,769 | A | 9/1990 | Schowiak | |
| 5,064,119 | A | 11/1991 | Mellette | |
| 5,090,623 | A | 2/1992 | Burns et al. | |
| 5,119,992 | A | 6/1992 | Grime | |
| 5,141,161 | A | 8/1992 | Anderson et al. | |
| 5,218,993 | A | 6/1993 | Steinberg et al. | |
| 5,332,159 | A | 7/1994 | Grime et al. | |
| 5,392,992 | A | 2/1995 | Farnsteiner et al. | |
| 5,609,302 | A | 3/1997 | Smith | |
| 5,732,886 | A | 3/1998 | Liaw | |
| 5,836,517 | A | 11/1998 | Burns et al. | |
| 6,019,294 | A | 2/2000 | Anderson et al. | |
| 6,450,422 | B1 | 9/2002 | Maggio | |
| 6,708,900 | B1 * | 3/2004 | Zhu et al. | 239/296 |
| 6,860,438 | B1 | 3/2005 | Huang | |
| 7,360,720 | B2 | 4/2008 | Gohring et al. | |
| D604,393 | S | 11/2009 | Johnson et al. | |
| 7,694,893 | B2 | 4/2010 | Zittel et al. | |
| 7,922,107 | B2 * | 4/2011 | Fox | 239/600 |
| 7,959,191 | B2 * | 6/2011 | Schouten | 285/298 |
| 7,971,806 | B2 | 7/2011 | Johnson et al. | |
| 2003/0071144 | A1 * | 4/2003 | Naemura | 239/390 |
| 2004/0089742 | A1 * | 5/2004 | Antonucci | 239/302 |
| 2005/0098691 | A1 * | 5/2005 | Yorns et al. | 248/126 |
| 2005/0145723 | A1 * | 7/2005 | Blette et al. | 239/525 |
| 2007/0080243 | A1 | 4/2007 | Alexander | |
| 2007/0205305 | A1 | 9/2007 | Vagedes | |
| 2008/0296409 | A1 | 12/2008 | Micheli | |
| 2009/0008481 | A1 | 1/2009 | Smith et al. | |
| 2010/0008804 | A1 | 1/2010 | Liska | |

FOREIGN PATENT DOCUMENTS

| | | | |
|---|---|---|---|
| CN | 201543532 | U | 8/2010 |
| DE | 102006019364 | A1 | 10/2007 |
| EP | 1679125 | A1 | 7/2006 |
| WO | 2007122094 | A1 | 11/2007 |
| WO | 2009029926 | A1 | 3/2009 |
| WO | WO 2009/137425 | A2 | 11/2009 |
| WO | WO 2009/140472 | A1 | 11/2009 |
| WO | 2010/080365 | A1 | 7/2010 |

OTHER PUBLICATIONS

Wagner Wideshot Power Painter, Owner's manual, 20 pp, dated Oct. 2006.

Graco press release New HVLP TurboForce, dated Jan. 3, 2009, accessed at http://public.graco.be/0/?=588.

Binks Model 18N Spray Gun, dated Apr. 1989, accessed at http://www.binks.com/Service%20Bulletins/77-1795r-12.pdf on Sep. 4, 2009.

Greco, Fine Finish Solutions, dated Dec. 2008, accessed at http://wwwd.graco.com/Distributors/DLibrary.nsf/Files/300564/$file/300564G.pdf on Nov. 19, 2009, 13 pp.

PCT/US2010/055051 International Search Report and Written Opinion mailed May 9, 2011, 15 pages.

Wagner The Painting People Control Spray Owner s Manual, pp. 1 and 4-6 (4 pages total), © 2005 Wagner Spray Tech, Commerically Available 2005.

Views of the Commercially Available product cited in Row 1 of Non-Patent Literature Documents (previously referenced; see above), 1 page, 2005.

First Office Action from Chinese Application No. 201080052349.X, issue date May 16, 2014. With English Translation. 17 Pages.

Second Office Action from Chinese Counterpart Application No. 201080052349.X, Issuing Date: Oct. 30, 2014, 14 pages.

* cited by examiner

SPRAYER FOR A FLUID DELIVERY SYSTEM

BACKGROUND

The present disclosure generally relates to a sprayer for a fluid delivery system, and more specifically, but not by limitation, to a spray gun for a paint spraying system.

One example of a fluid delivery system comprises a spray-coating system having a device configured to spray a fluid material (e.g., paint, ink, varnish, texture, etc.) through the air onto a surface. Such spray-coating systems often include a fluid material source and, depending on the particular configuration or type of system, a motor for providing pressurized fluid material and/or air to an output nozzle or tip that directs the fluid material in a desired spray pattern. For example, some common types of fluid delivery systems employ compressed gas, such as air compressed by an air compressor, to direct and/or atomize fluid material particles onto a surface. Fluid material is provided from the fluid material source using pressure feed, suction feed, and/or gravity feed mechanisms, for example. Other common types of fluid delivery systems include airless systems that employ a pumping unit for pumping fluid material from a source, such as a container.

The discussion above is merely provided for general background information and is not intended to be used as an aid in determining the scope of the claimed subject matter.

SUMMARY

The present disclosure generally relates to a sprayer for a fluid delivery system, and more specifically, but not by limitation, spray gun for a paint spraying system.

In one exemplary embodiment, a sprayer for a fluid delivery system is provided. The sprayer includes a main body having a handle and a trigger. The sprayer also includes a spray head having a fluid input for receiving fluid material and a fluid output for spraying the fluid material. The spray head is removably couplable to the main body by rotating the spray head with respect to the main body to engage a connection component of the spray head to a corresponding connection component of the main body. The sprayer also includes a spray head locking mechanism on the main body that extends to engage a portion of the spray head.

In one exemplary embodiment, a fluid sprayer is provided and includes a body portion having at least a trigger and a handle. The fluid sprayer includes a spray head portion having an internal chamber configured to receive a flow of air. The spray head portion includes an airflow path configured to provide at least a portion of the flow of air to an outlet for pressurizing a fluid container. The spray head portion also includes a valve positioned along the airflow path between the outlet and the internal chamber.

In one exemplary embodiment, a sprayer is provided and includes a body and a spray head removably couplable to the body. The spray head has an airflow outlet for providing pressurizing air to a fluid container and a fluid inlet for receiving fluid material from the pressurized fluid container. The spray head also includes a port configured to release pressure from the fluid container when the spray head is decoupled from the body.

In one exemplary embodiment, a sealing mechanism for a needle valve in a fluid sprayer is provided. The sealing mechanism includes a packing material that is configured to engage and form a fluid seal with a needle of the needle valve. The sealing mechanism also includes a packing retainer that is removably couplable to the fluid sprayer. The packing material is at least partially disposed within the packing retainer such that a portion of the packing material extends beyond an end of the packing retainer.

These and various other features and advantages will be apparent from a reading of the following Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
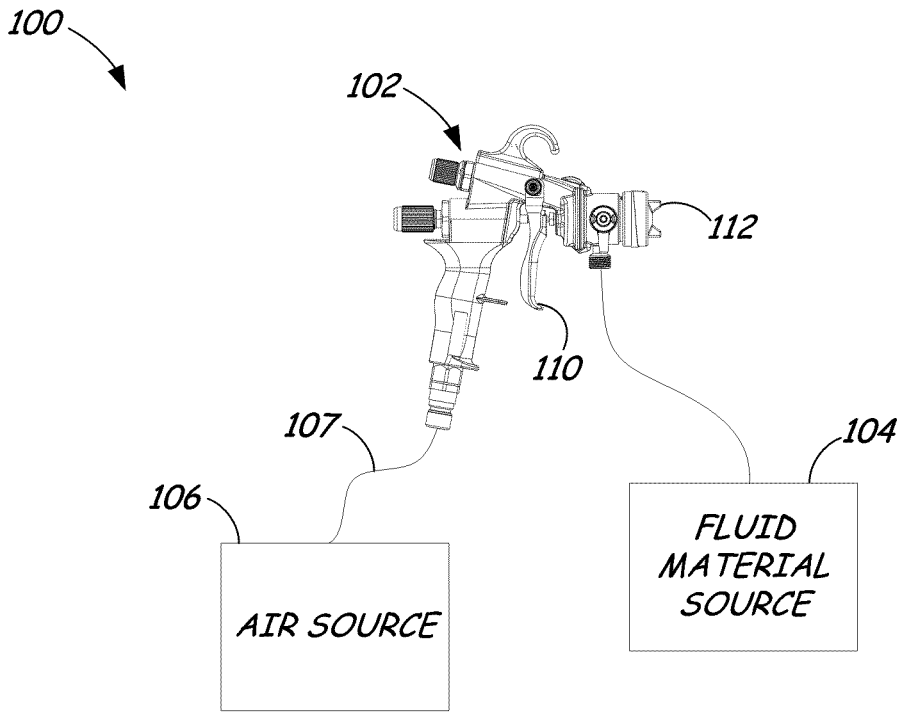
FIG. 1 is a diagram illustrating an exemplary fluid delivery system.

FIG. 1 is a diagram illustrating an exemplary fluid delivery system 100. System 100 includes a spray gun 102 configured to spray fluid material from an output 112 when a trigger 110 is actuated (i.e., pulled). Output 112 comprises a nozzle or tip configured to discharge the fluid material in a desired spray pattern. In one embodiment, the fluid material is entrained in an airflow from spray gun 102. In one particular example, spray gun 102 is configured to atomize the fluid material that is sprayed through the air. Examples of fluid materials include, but are not limited to, primers, inks, paints, varnishes, block fillers, elastomerics, drywall mud, textures, popcorn, and splatter finishes, herbicides, insecticides, and food products, to name a few.

In one embodiment, fluid delivery system 100 comprises an airless system that employs a fluid source and, depending on the particular configuration or type of system, an electric motor or drive for providing pressurized fluid to output 112. In the embodiment illustrated in FIG. 1, fluid delivery system 100 comprises an air-driven system that employs air (e.g., air compressed by an air compressor, air provided from a turbine, etc.) to pressurize and propel material from output 112.

A fluid material source 104 is configured to provide fluid material to spray gun 102. Fluid material is provided from the fluid material source 104 using pressure feed, suction feed, and/or gravity feed mechanisms, for example. Material source 104 can be mounted to spray gun 102 (e.g., an onboard hopper or container) and/or can be remote from (e.g., not mounted to) spray gun 102. One example of a fluid material container that can be utilized with spray gun 102 is illustrated in commonly assigned U.S. Pat. No. 5,655,714, the content of which is hereby incorporated by reference in its entirety.

Air source 106 is configured to provide air to spray gun 102 that is used to atomize and propel the fluid material provided from fluid material source 104. Air source 106 can be mounted to spray gun 102 (e.g., an onboard turbine or compressor) and/or can be remote from (e.g., not mounted to) spray gun 102. In the embodiment illustrated in FIG. 1, air source 106 comprises an air compressor that provides compressed air to spray gun 102 through a tube 107.

Figure 2:
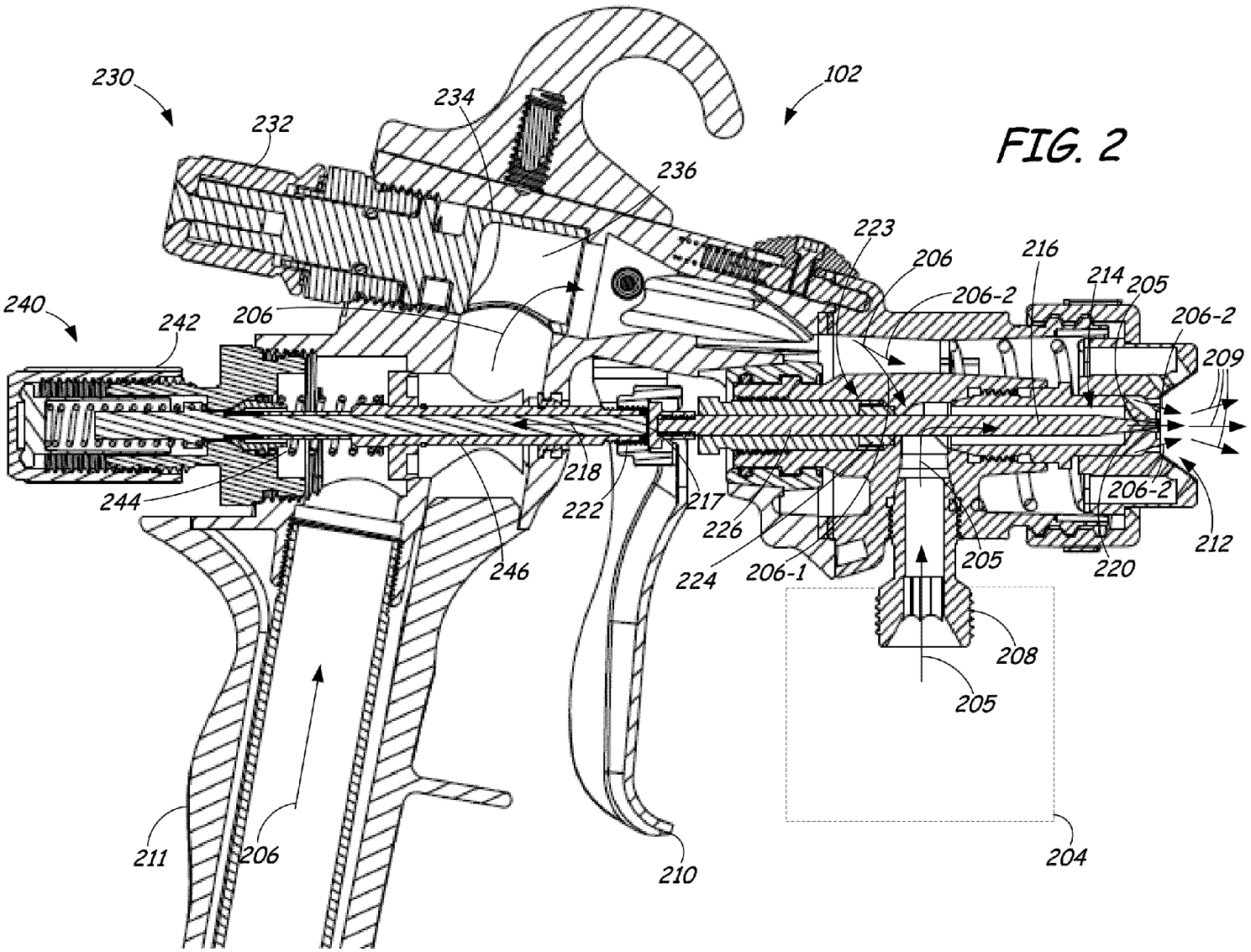
FIG. 2 is a cross-sectional view of a spray gun, under one embodiment.

FIG. 2 is a cross-sectional view of one embodiment of spray gun 102. As illustrated, spray gun 102 receives pressurized air from an air source, such as air source 106 illustrated in FIG. 1. The pressurized air flows through a handle 211 of spray gun 102 along a path illustrated by arrows 206. Some of the air (generally represented by arrows 206-1) is provided to a fluid container 204 (such as fluid container 104 illustrated in FIG. 1) through a first connection tube or conduit (not illustrated in the cross-sectional view of FIG. 2) to pressurize the fluid material in the fluid container 204. The pressure in the container 204 forces fluid material (generally represented by arrows 205) into spray gun 102 through a second connection tube or conduit. In one embodiment, the second connection tube comprises a threaded connection 208 for connecting the container 204 to spray gun 102. The fluid material flow 205 is provided to the output nozzle 212 and is atomized by air provided from the air source (generally represented by arrow 206-2). In one embodiment, the fluid material and air are internally mixed in a chamber or cavity within spray head 303. In the illustrated embodiment, the fluid material flow 205 and air flow 206-2 are mixed externally. In one example, the fluid material flow 205 is centralized through the nozzle 212 and the atomizing air 206-2 is provided along an outer diameter of the nozzle 212 to atomize and direct the fluid material 205. The fluid material/air mixture (generally represented by arrows 209) is sprayed from output nozzle 212 in a particular spray pattern, depending on the configuration of nozzle 212.

Spray gun 102 includes a needle valve 214 for controlling the spray 209 from the nozzle 212. Needle valve 214 comprises a needle 216 that is actuated by trigger 210 in a direction 218 to disengage needle 216 from a nozzle seat 220. In one embodiment, needle 216 is positioned in an aperture formed in trigger 210. Needle 216 includes a head 217 that is larger than the aperture and is configured to engage and be actuated by the trigger 210. Needle 216 is movable between a closed position (i.e., needle 216 is engaged to nozzle seat 220 to create a seal) that limits or prevents flow 209 from nozzle 212 and an open position (i.e., needle 216 is not engaged to nozzle seat 220) that allows flow 209 from nozzle 212. In one embodiment, one or more springs (such as spring 222) are configured to engage needle 216 and/or trigger 210 to bias the needle 216 to the closed position.

Spray gun 102 includes a needle valve sealing mechanism 223 that limits or prevents the fluid flow 205 from container 204 (and/or the air flow 206) from leaking along needle 216 away from nozzle 212 (i.e., in direction 218). In one embodiment, spray gun 102 includes a packing material 224 positioned around needle 216 that creates a sealing engagement with needle 216 and/or other internal surfaces of spray gun 102. A packing retainer or nut 226 is threadably engaged in the spray gun 102 and is utilized to hold packing material 224 in spray gun 102.

In one embodiment, spray gun 102 includes an airflow control mechanism 230 configured to control (e.g., start, increase, decrease, stop, etc.) the air flow 206. Airflow control mechanism 230 includes an airflow control knob 232 operably coupled to an airflow control valve 234 having a cavity 236 formed therein. Knob 232 is rotatable by a user to open and close the airflow control valve 234. In one embodiment, the volume of the airflow 206 through valve 234 is a function of the rotational position of cavity 236 with respect to spray gun 102.

In one embodiment, spray gun 102 includes a fluid flow control mechanism 240 configured to control (e.g., increase, decrease, etc.) the volume of the fluid flow 205 from nozzle 212. As illustrated, fluid flow control mechanism 240 includes a fluid flow control knob 242 that is rotatable by a user. Rotation of knob 242 causes compression (or expansion) of a spring 244 against a rod 246, which affects the maximum distance the needle 216 can retract from the nozzle seat 220 when the trigger is actuated (i.e., pulled) by a user.

Figure 3:
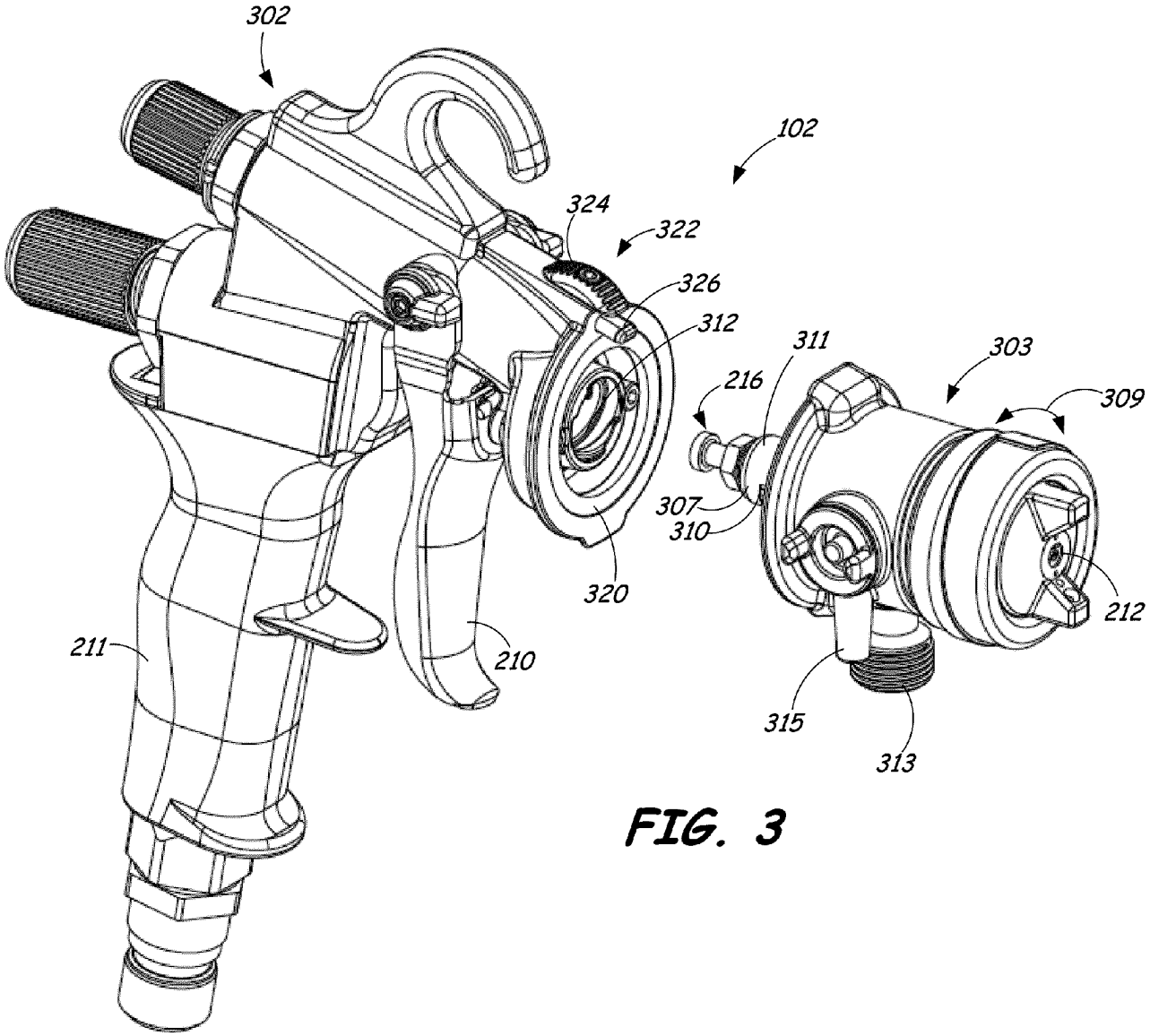
FIG. 3 is a perspective view of a spray gun, under one embodiment.

FIG. 3 is a perspective view of one embodiment of spray gun 102. As illustrated, spray gun 102 comprises a main body 302 and a spray head 303 that is removably couplable to the body 302. Body 302 includes trigger 210 and handle 211. Spray head 303 includes one or more connections for a fluid container. In the illustrated embodiment, a first connection 313 provides a fluid path from the fluid container to the nozzle 212 of the spray gun 302. A second connection 315 provides an air flow path for providing pressurizing air to the fluid container. One or more of the connections 313 and 315 can include threads for securing the fluid container to the spray head 303.

Figure 4:
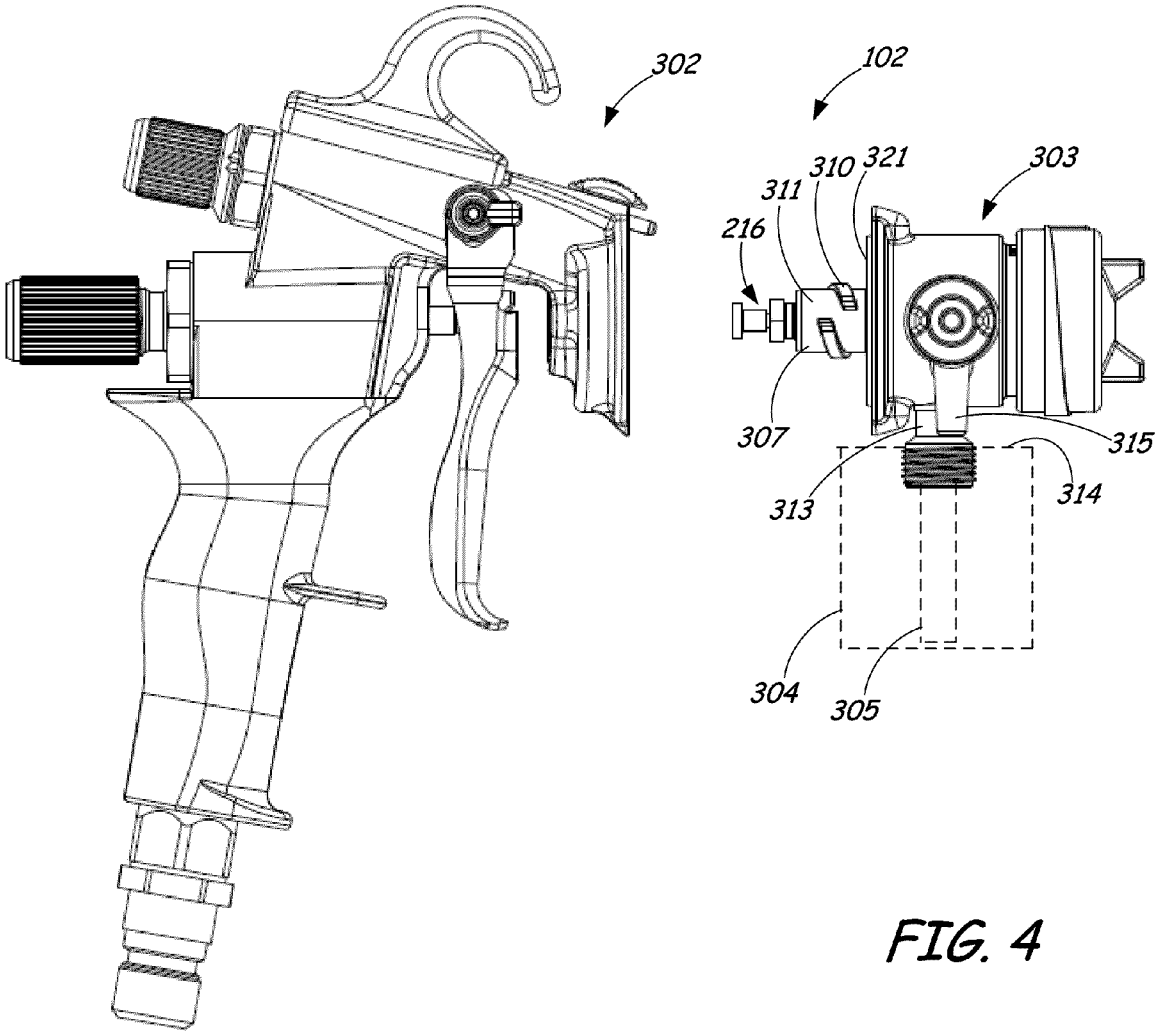
FIGS. 4 and 5 are side views of the spray gun illustrated in FIG. 3.
Figure 5:
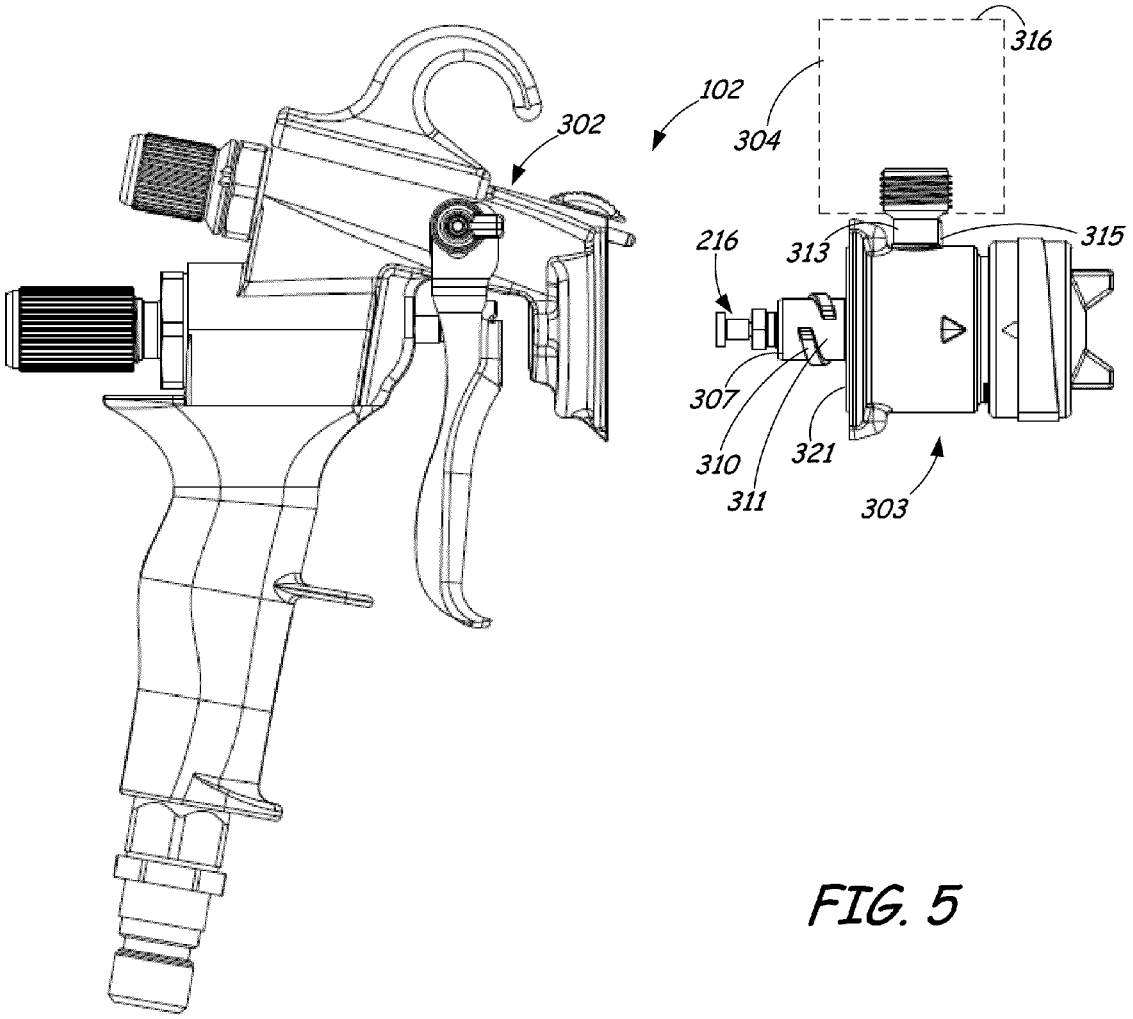

In accordance with one embodiment and as illustrated in FIGS. 4 and 5, spray head 303 can be connected to body 302 in a plurality of configurations. For example, in a first configuration shown in FIG. 4 spray head 303 is coupled to body 302 such that a fluid container 304 is positioned on a first (i.e., bottom) side of spray head 303. In this orientation, fluid is provided from fluid container 304 by pressure and/or suction feed. For instance, pressurizing air is provided to the container 304 from connection 315 (for example, using a tube connected to a top 314 of container 304). The pressure in the container 304 forces fluid to flow up a tube 305 through connection 315 and into spray head 303.

In a second configuration shown in FIG. 5, spray head 303 is coupled to body 302 such that fluid container 304 is positioned on a second (i.e., top) side of spray head 303. In this orientation, fluid is provided from fluid container 304 by gravity-assisted pressure feed. For instance, pressurizing air is provided to the container 304 from connection 315 (for example, using a tube connected to a top 316 of container 304). It is noted that the fluid containers 304 illustrated in FIGS. 4 and 5 can comprise the same or different types of containers.

In accordance with one embodiment, spray head 303 can be coupled to and decoupled from body 302 by a user without the use of tools. For example, as illustrated in FIGS. 3-5 spray head 303 includes a threaded connection 307 for connecting and disconnecting spray head 303 from body 302 through rotation of spray head 303 with respect to body 302. In one embodiment, the threaded connection 307 comprises one or more threads 310 disposed about a substantially cylindrical portion 311 of spray head 303. The portion 311 extends from spray head 303 and is configured to be received by a corresponding receptacle 312 (also shown in FIG. 6) having a corresponding threaded connection configured to receive threads 310. In one embodiment, receptacle 312 comprises a "female" connector that receives and secures corresponding "male" connector 307 therein. Receptacle 312 can be secured to body 302 using bolts or screws, for example.

In both configurations shown in FIGS. 4 and 5, spray head 303 connects to (and disconnects from) body 302 by rotating the spray head 303 with respect to body 302 (i.e., in directions 309). In one embodiment, a surface 320 of body 302 forms a sealing engagement with a corresponding surface 321 of spray head 303.

In accordance with one embodiment, needle 216 is configured to remain disposed (or at least partially disposed) within spray head 303 when spray head 303 is decoupled from body 302. In this manner, the needle 216 remains engaged to the nozzle seat (i.e., nozzle seat 212) when the spray head 303 is removed from the body 302 such that pressurized fluid in the container 204 is not discharged during and/or after removal of the spray head 303. This is advantageous as it can operate to limit, or prevent, fluid leakage or spills from spray gun 102 during removal of spray head 303.

In accordance with one embodiment, body 302 includes a locking mechanism 322 that is configured to limit or prevent rotation of spray head 303 with respect to body 302, thereby locking spray head 303 on body 302. As illustrated, locking mechanism 322 includes a mechanical slider 324 and a pin 326 extending from body 302 (see also FIG. 6). Mechanical slider 324 is connected to pin 326 by a screw 328 (shown in FIG. 6). Movement of slider 324 actuates pin 326 between an extended state (shown in FIG. 3) and a retracted state. A spring 330 (shown in FIG. 6) biases the pin 326 to the extended state. The pin 326 is configured to be received within at least one aperture (not shown in FIG. 3) formed in the spray head 303. For example, a first aperture can be formed in spray head 303 for receiving pin 326 when spray head 303 is oriented as shown in FIG. 4 and a second aperture can be formed in spray head 303 for receiving pin 326 when spray head 303 is oriented as shown in FIG. 5. When the spray head 303 is to be decoupled from body 302, the user actuates mechanical slider 324 to retract pin 326 from spray head 303, thereby allowing the user to rotate the spray head 303.

Figure 6:
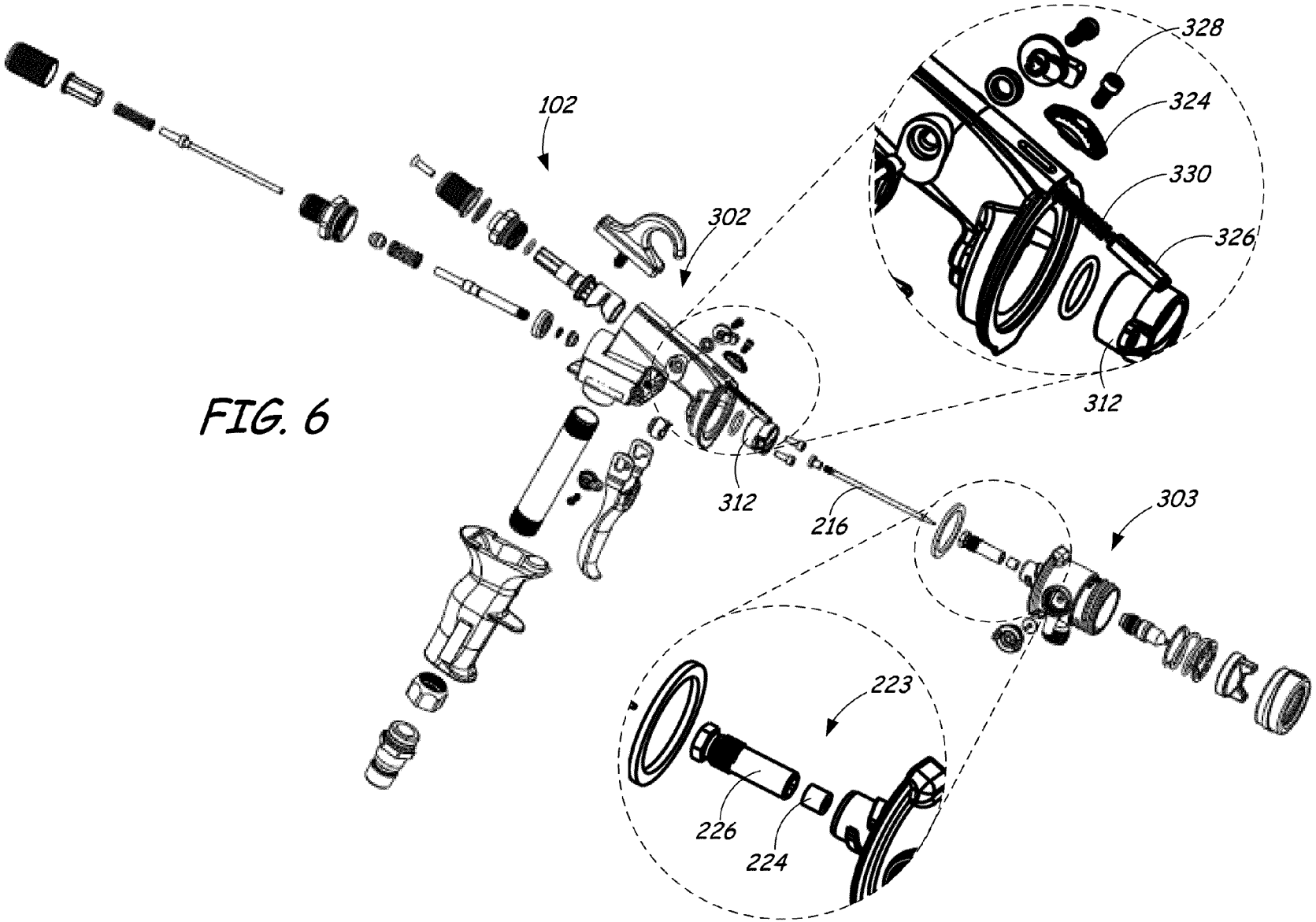
FIG. 6 is an exploded view of a spray gun, under one embodiment.

FIG. 6 is an exploded view of spray gun 102. As illustrated, needle valve sealing mechanism 223 includes a packing material 224 and a packing retainer or nut 226. In one embodiment, packing material 224 comprises a polymer material, such as, but not limited to, fluoropolymers. One particular example is sold by E. I. du Pont de Nemours and Company (Wilmington, Del.) under the product name Teflon®. In one embodiment, packing material 224 is substantially cylindrical and is configured to be received at least partially within packing retainer 226. Packing retainer 226 is configured to be secured to spray head 303 to retain packing material 224 in a sealing engagement with spray head 303 and/or needle 216.

Figure 7:
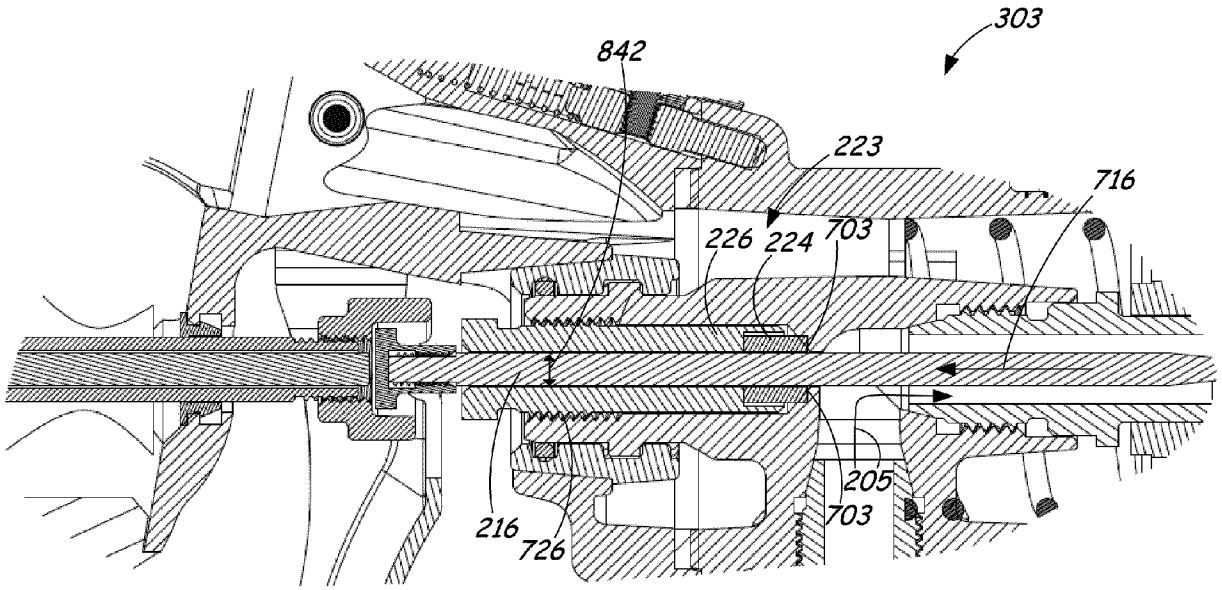
FIG. 7 is a cross-sectional view of a portion of the spray gun illustrated in FIG. 6.

FIG. 7 is a cross sectional view of a portion of spray head 303 illustrating packing material 224 and packing retainer 226. As shown, the fluid flow 205 from the fluid container travels along needle 216 to the nozzle. Packing 224 is configured to prevent the fluid from leaking along the needle 216 in a direction illustrated by arrow 716. In one embodiment, packing material 224 engages a surface 703 of spray head 303 to form the seal. Alternatively, or in addition, packing material 224 can be configured to engage and form a seal with needle 216. For example, an inner diameter 846 of packing material 224 can be substantially the same as a diameter 842 of needle 216. Diameter 846 (shown in FIG. 8A) can also be larger (or smaller) than diameter 842. Further, compression of packing material 224 against surface 703 can cause packing material 224 to expand and form a seal against needle 216.

Packing retainer 226 is secured to spray head 303 by a threaded connection 726 comprising corresponding threads on spray head 303 and packing retainer 226. In some instances, movement of needle 216 along packing material 224 over time can cause the packing material 224 to degrade, necessitating replacement of the material. In accordance with one embodiment, packing material 224 has an outer diameter 836 that is approximately the same as, or slightly larger than, the diameter 838 of a cavity 826 of retainer 226 (see FIG. 8A). In this manner, packing material 224 fits securely within cavity 826 such that packing material 224 is removed from spray head 303 as packing retainer is removed. A user can then easily remove the packing material 224 (i.e., without the use of tools) from the packing retainer 226 by simply pulling the packing material 224 from the retainer 226. In one embodiment, the length 832 of packing material 224 is greater than the length 830 of cavity 826. In this manner, when packing material 224 is positioned within retainer 226 the packing material 224 extends beyond an end 834 of retainer 226 allowing a user to grip a portion of packing material 224 during removal and insertion of packing material 224. In one embodiment, the packing material 224 extends at least approximately 0.06 inches beyond the end 834 of the packing retainer 226. A new packing material 224 can be placed in the packing retainer 226 and reinserted into the spray head 303.

Figure 8C:
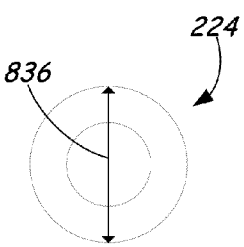
FIGS. 8B and 8C are end views of a packing retainer and packing material of the fluid seal mechanism illustrated in FIG. 8A, under one embodiment.
Figure 8B:
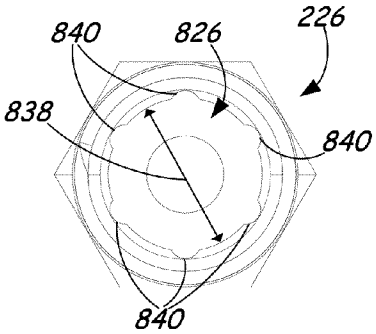
Figure 8A:
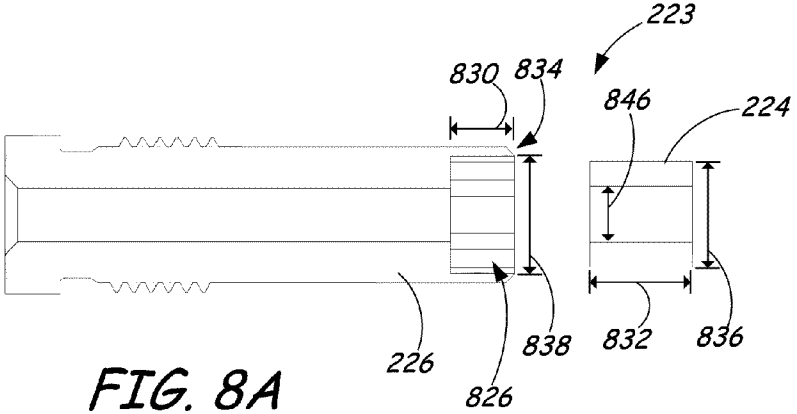
FIG. 8A is a cross-sectional view of a fluid seal mechanism illustrated in FIG. 7, under one embodiment.

FIGS. 8B and 8C are end views of packing retainer 226 and packing material 224, respectively. In one embodiment, to provide a secure engagement between packing material 224 and packing retainer 226 (i.e., so that the packing material 224 does not fall out of the packing retainer 226), the packing material 224 has a larger diameter 836 than the diameter 838 of recess 826. When packing material 224 is pressed into cavity 826 of packing retainer 226 (i.e., during assembly of mechanism 223 into spray head 303), grooves 840 formed in retainer 226 allow for the deformation of the packing material 224 (i.e., some of the packing material 224 flows into grooves 840).

Figure 9A:
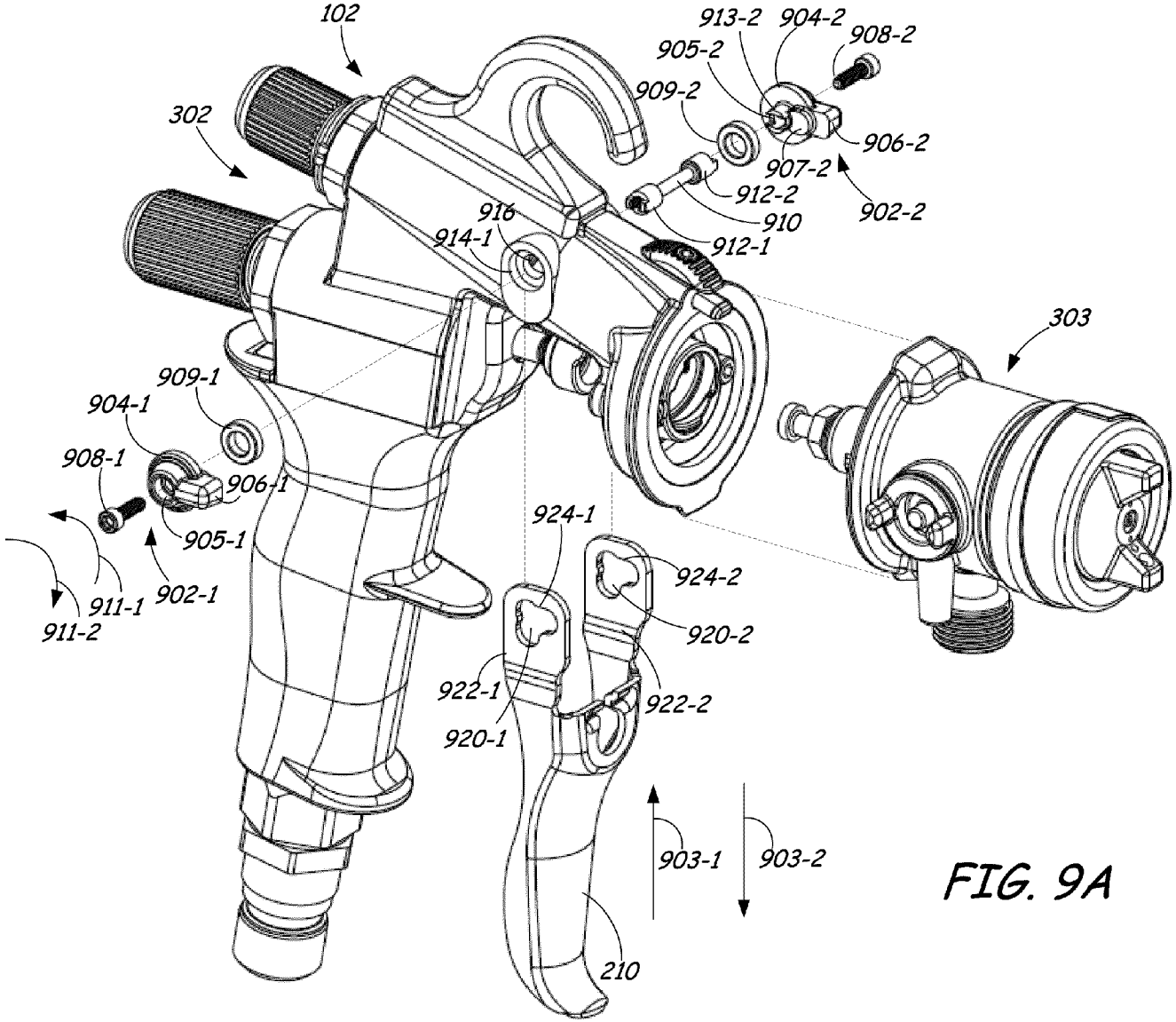
FIG. 9A is a partially exploded perspective view of a spray gun, under one embodiment.
Figure 9B:
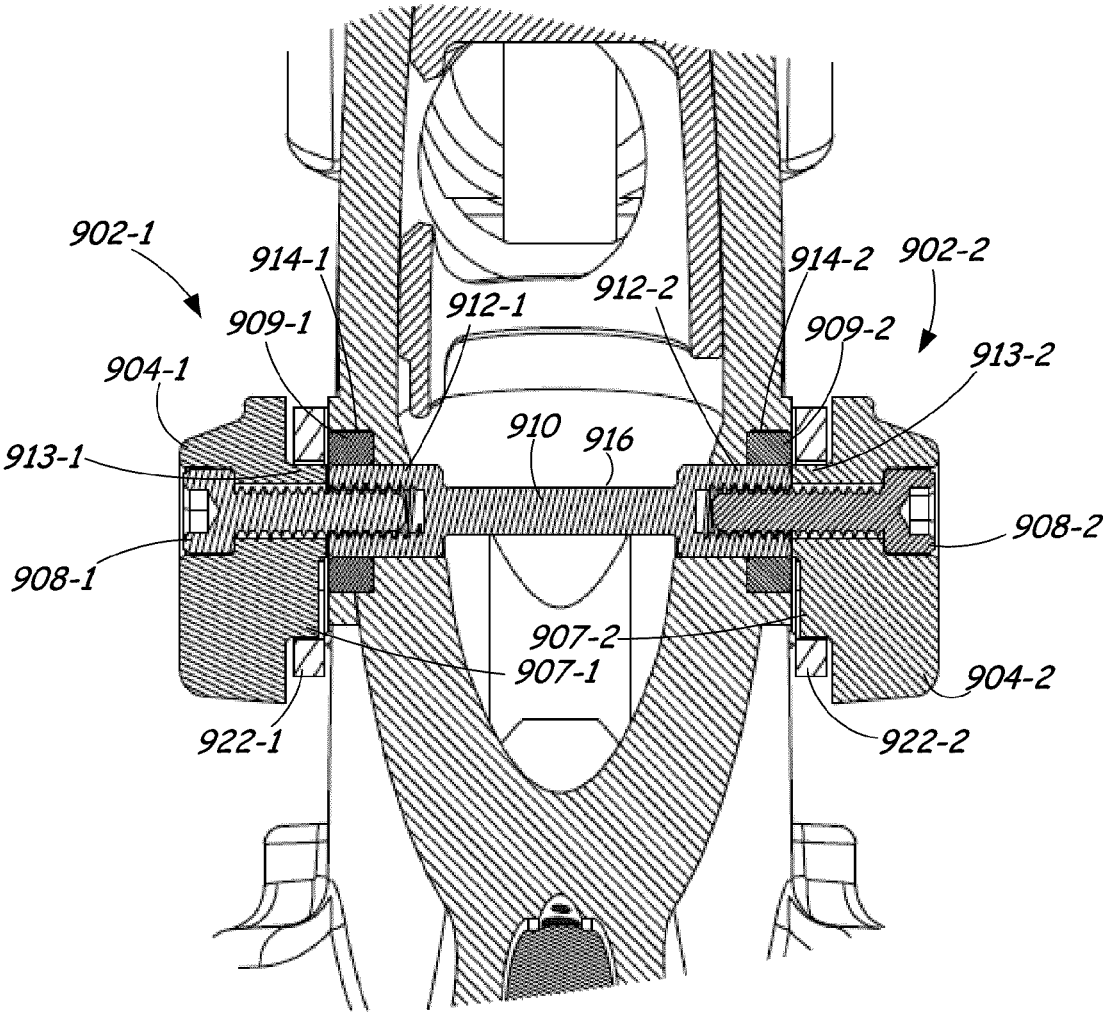
FIG. 9B is a cross-sectional view of the spray gun illustrated in FIG. 9A.
Figure 10:
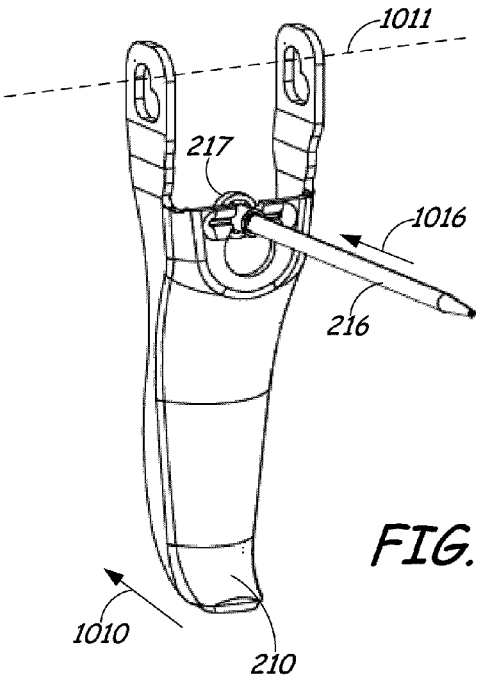
FIGS. 10-12 are perspective views illustrating at least a portion of the needle valve assembly and trigger mechanism shown in FIG. 9.
Figure 11:
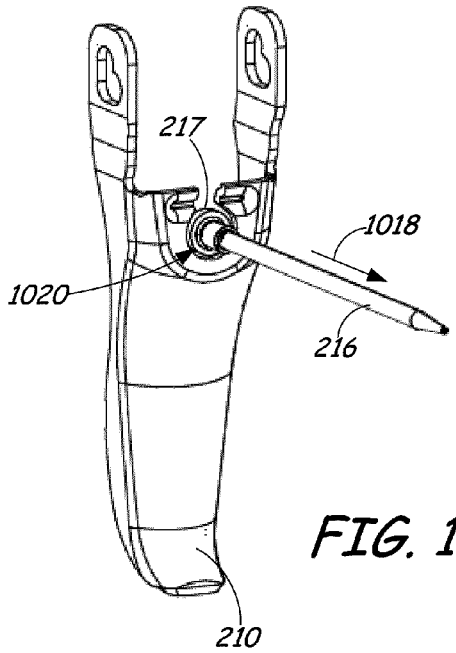

As mentioned above, trigger 210 is configured to engage needle 216 (for example, a head 217 of needle 216) for actuating the needle valve to spray fluid material. In accordance with one embodiment, trigger 210 is also configured to be disengaged from the needle 216 thereby allowing needle 216 to remain in the spray head 303 when the spray head 303 is removed from body 302. As illustrated in FIGS. 9A and 9B, spray gun 102 includes at least one "trigger hold" mechanism (illustratively mechanisms 902-1 and 902-2, collectively referred to as trigger hold mechanisms 902) that are configured to actuate the trigger 210 between a first, needle engaging position (shown in FIG. 10) and a second, needle disengaging position (shown in FIG. 11). In the needle engaging position shown in FIG. 10, the head 217 of needle 216 is contacted by trigger 210 to actuate the needle 216 in a direction 1016 when the trigger is pulled in a direction 1010 (i.e., rotating the trigger about an axis 1011). In the needle disengaging position shown in FIG. 11, an aperture 1020 of trigger 210 is positioned such that the head 217 of needle 216 passes through the aperture 1020 when the spray head 303 is pulled away from the body 302 (i.e., needle 216 is moved in direction 1018). In this manner, trigger 210 does not pull the needle 216 away from the nozzle seat during removal of the spray head 303.

Figure 12:
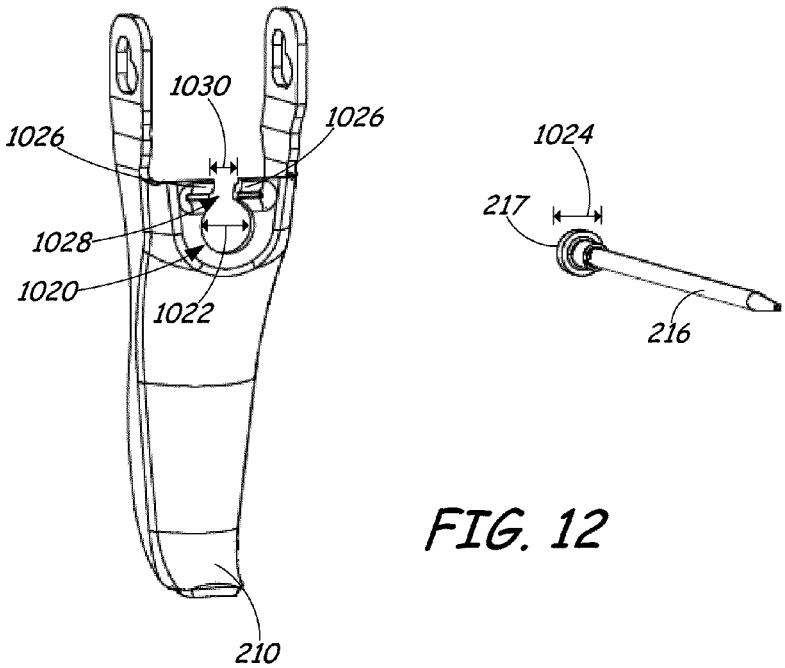

In the embodiment illustrated in FIG. 12, the aperture 1020 has a diameter 1022 that is larger than the diameter 1024 of needle head 217. Further, trigger 210 includes needle head engaging protrusions or arms 1026 that are separated by a gap 1028. Gap 1028 has a width 1030 that is smaller than the diameter 1024 of needle head 217.

Referring again to FIGS. 9A and 9B, trigger 210 is attached to body 302 by fasteners 908-1 and 908-2 (collectively referred to as fasteners 908) that secure members 904-1 and 904-2 (collectively referred to as members 904) to body 302. FIG. 9B is a sectional view of spray gun 102 taken along a plane defined by fasteners 908. Members 904 can act as collars or washers and include apertures 905-1 and 905-2 (collectively referred to as apertures 905) formed therethrough that are configured to receive fasteners 908, which can comprise threaded bolts, for example. Each member 904 can include a bushing portion 913-1 and 913-2 that extends from member 904 and is positioned within apertures 920-1 and 920-2 (collectively referred to as apertures 920) formed in arms 922-1 and 922-2 (collectively referred to as arms 922) of trigger 210.

A shaft 910 is positioned within an orifice 916 formed in body 302. Shaft 910 is rotatable within orifice 916 and is configured to mechanically connect members 904. In the illustrated embodiment, fastener 908-1 secures member 904-1 to a first end 912-1 of shaft 910 and fastener 908-2 secures member 904-2 to a second end 912-2 of shaft 910. Thus, rotation of one of members 904 causes corresponding rotation in the other member 904.

In one embodiment, seals or bushings 909-1 and 909-2 (collectively referred to as seals 909) are positioned between body 302 and each of members 904. In one example, seals 909 can comprise o-rings positioned within cavities 914-1 and 914-2 formed in body 302 proximate orifice 916. Seals 909 can operate to limit or prevent the leakage of air and/or fluid material from spray gun 102. For example, in one embodiment shaft 910 is positioned within the air flow from the air source (e.g., air flow 206 illustrated in FIG. 2). Seals 909 can prevent the air flow from leaking out of cavities 914.

In accordance with one embodiment, members 904 are rotatable (i.e., in directions represented by arrows 911-1 and 911-2) to move trigger 210 (i.e., in directions represented by arrows 903-1 and 903-2) between the needle engaging and disengaging positions. In one embodiment, members 904 include protrusions 906-1 and 906-2 that provide a gripping surface to rotate members 904.

Each of members 904 also include a protrusion 907-1 and 907-2 (collectively referred to as protrusions 907) that is positioned within the apertures 920 formed in arms 922. When members 904 are rotated in direction 911-1, protrusions 906 engage surfaces 924-1 and 924-2 (collectively referred to as surfaces 924) of arms 922 and lift trigger 210 in direction 903-1. When members 904 are rotated in direction 911-2, trigger 210 is lowered in direction 903-2.

Figure 13:
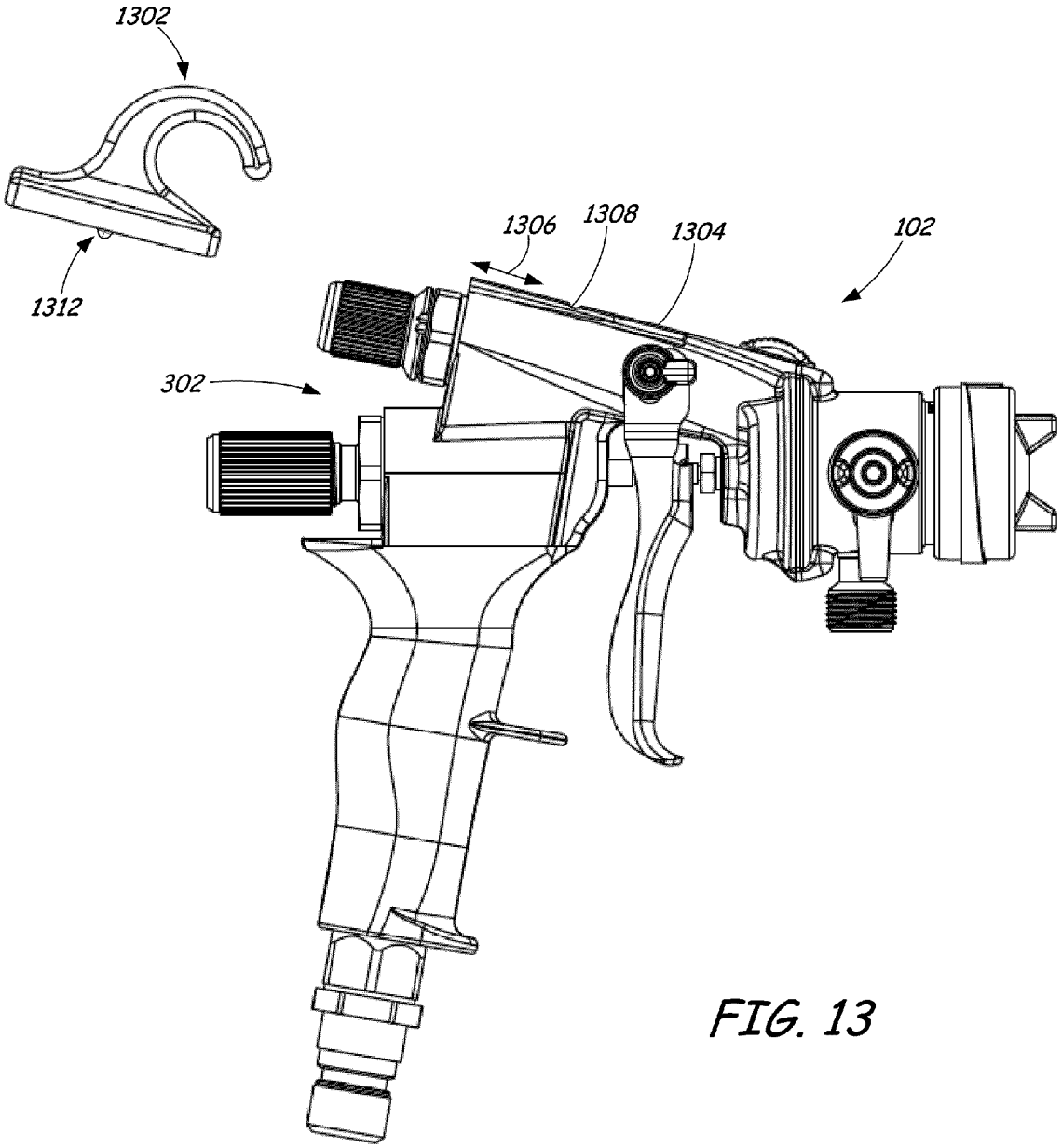
FIG. 13 is a side view of an exemplary spray gun including a hook mechanism.
Figure 14:
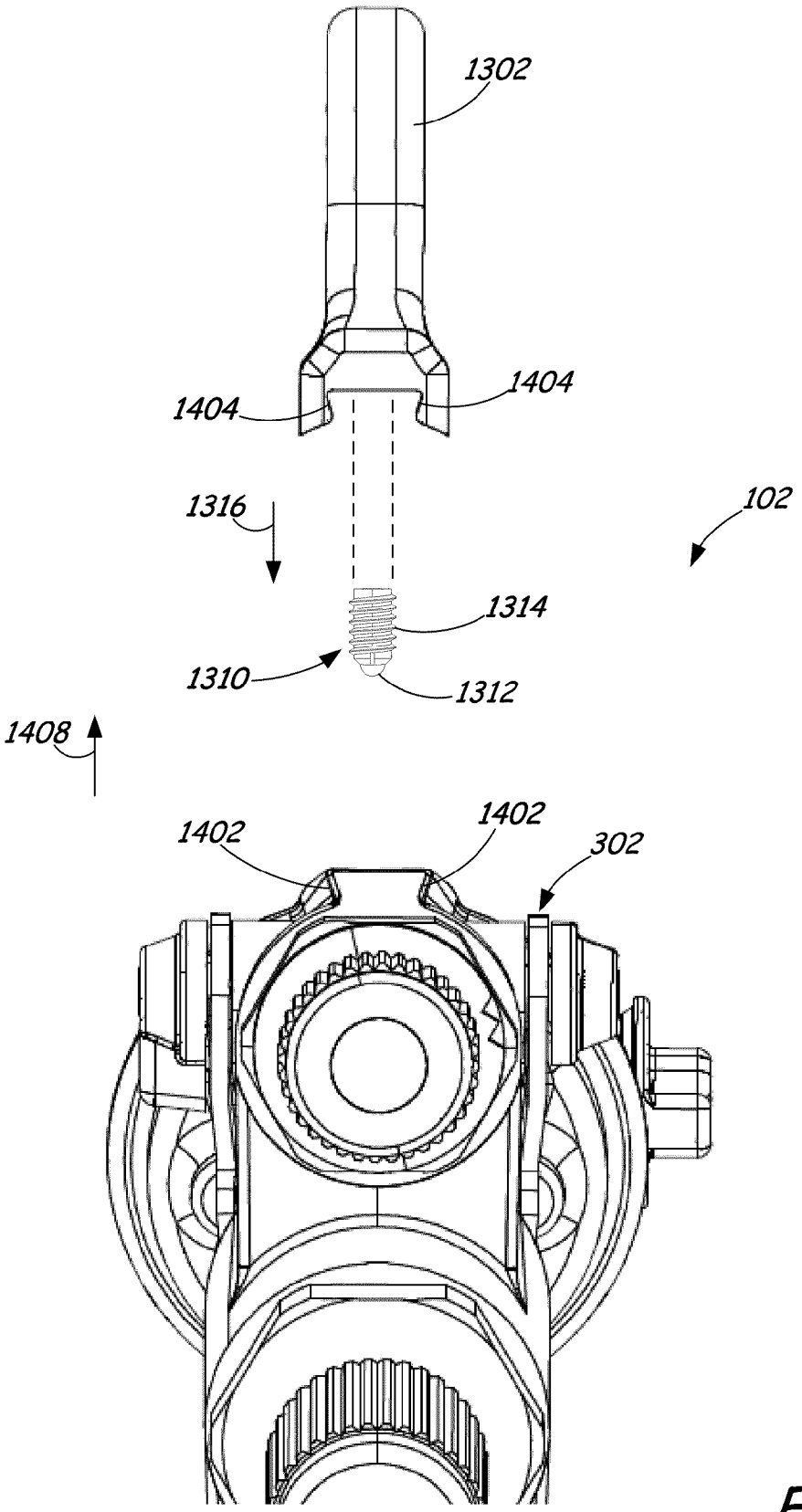
FIG. 14 is an exploded end view of the hook mechanism shown in FIG. 13.
Figure 15:
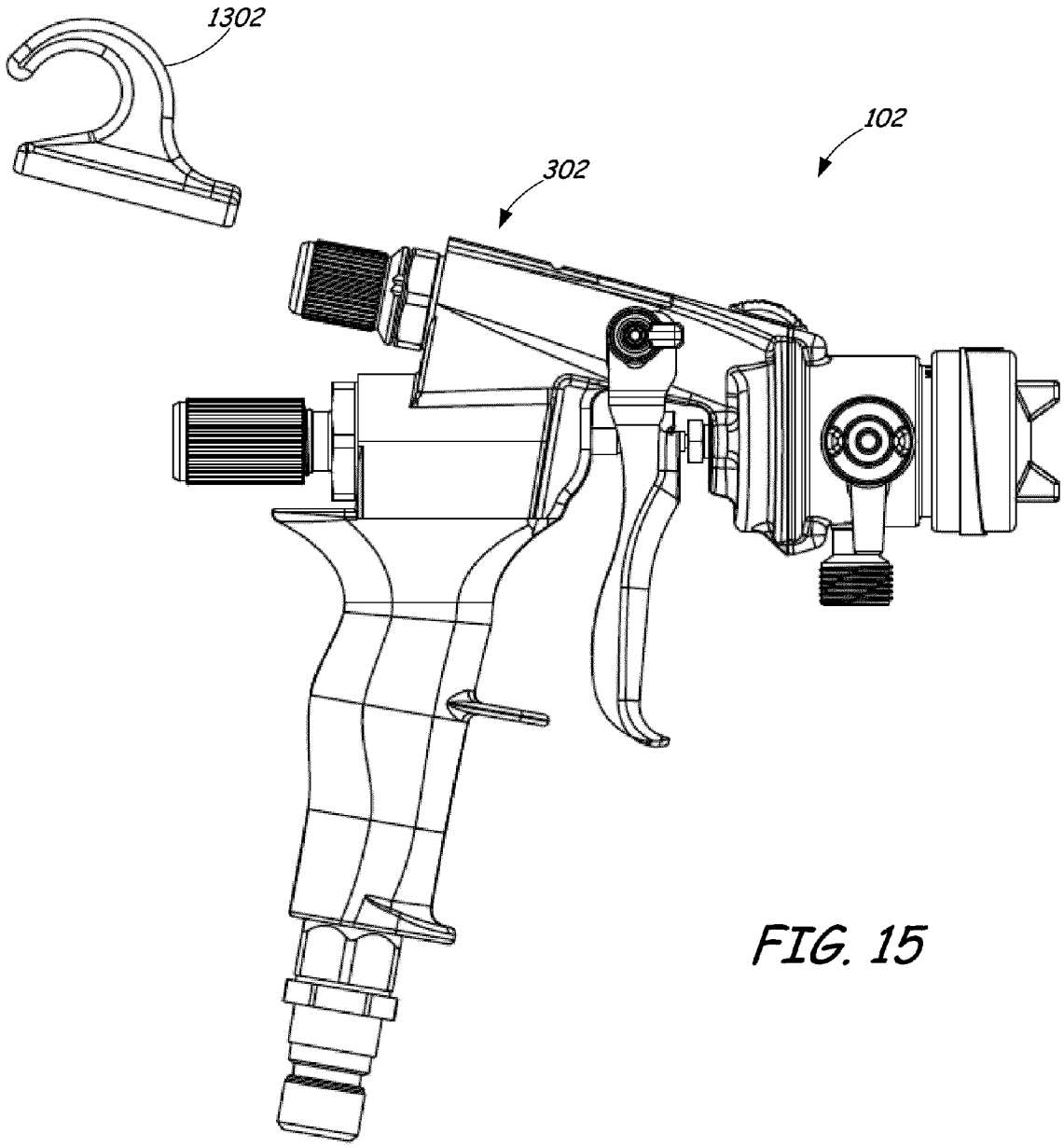
FIG. 15 is a side view of the exemplary spray gun illustrated in FIG. 13 showing the hook mechanism in an alternative orientation.

FIGS. 13-15 are views of spray gun 102 illustrating an exemplary hook 1302. Hook 1302 is attachable to body 302 and is configured to be utilized during operation, storage, transport, etc. of spray gun 102. For example, hook 1302 can be used to hang spray gun 102. Further, hook 1302 is reversible and can be attached to body 302 in multiple orientations, for example a first orientation shown in FIG. 13 and a second orientation shown in FIG. 15.

In one embodiment, hook 1302 is configured to be attached to and removed from body 302 without the use of tools. For example, hook 1302 is engaged to and disengaged from a top surface 1304 of body 302 by sliding hook 1302 along the top surface 1304 in directions illustrated by arrow 1306. In one embodiment, spray gun 102 includes a detent feature that retains the hook 1302 along the top surface 1304. The detent feature requires a particular amount of force to remove the hook 1302 from the top surface 1304. For instance, as illustrated in FIGS. 13 and 14 the top surface 1304 includes a notch 1308 configured to engage a ball 1312 of a retention member 1310. The retention member 1310 is threadably engaged to hook 1302 using threads 1314.

Ball 1312 can be spring-loaded within retention member 1310, if desired. For example, retention member 1310 can include a spring (not shown in FIG. 14) that provides a biasing force against the ball 1312 in a downward direction 1316.

In accordance with one embodiment, body 302 and hook 1302 includes corresponding angled surfaces 1402 and 1404. Angled surfaces 1402 and 1404 allow the hook 1302 to slide along top surface 1304 in direction 1306, but prevent the hook 1302 from being pulled away from the body 1302 in a vertical direction 1408.

Figure 16:
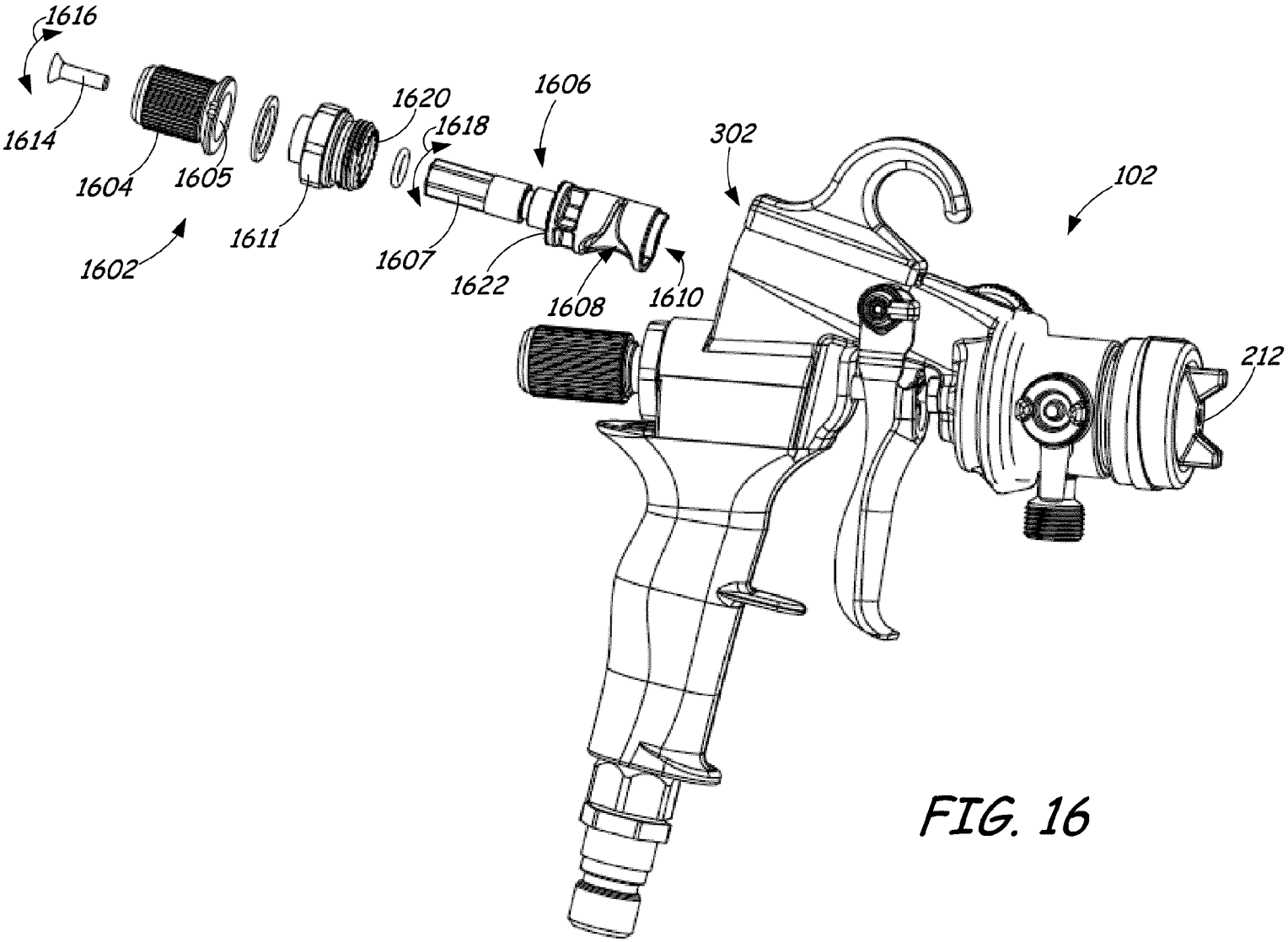
FIG. 16 is a partially exploded perspective view of an exemplary spray gun illustrating an airflow control mechanism, under one embodiment.

FIG. 16 is a partially exploded perspective view of spray gun 102 illustrating an airflow control 1602, under one embodiment. Airflow control 1602 is configured to control (e.g., start, stop, increase, decrease, etc.) the flow of air from an air source to nozzle 212. Airflow control 1602 includes a knob 1604 that is operably coupled to an airflow control valve 1606. A fastener 1614 can be utilized to couple knob 1604 and valve 1606. An inner surface 1605 of knob 1604 engages a corresponding surface 1607 of valve 1606 such that rotation of knob 1604 (generally represented by arrow 1616) produces corresponding rotation of valve 1606 (generally represented by arrow 1618). Valve 1606 includes an airflow input aperture 1608 and an airflow output aperture 1610. The input aperture 1608 has a particular size and shape such that the amount of airflow through the valve 1606 is a function of the rotational position of the valve 1606.

Airflow control 1602 includes a collar 1611 that is threadably engaged to body 302 of spray gun 102. Collar 1611 is secured to body 302 to retain the valve 1606 within body 302. A portion of valve 1606 is positioned within collar 1611 such that surface 1607 is engaged to knob 1604.

In accordance with one embodiment, airflow control 1602 includes detent features that are used to mechanically resist rotation of the airflow control valve 1606. As illustrated, collar 1611 includes detent features that comprise a plurality of protrusions or ribs 1620 configured to engage corresponding protrusions or ribs 1622 on airflow control valve 1606. As a user rotates knob 1604, the protrusions 1622 of collar 1611 (which is connected to body 302) engage the protrusions 1620 of airflow control valve 1606 as valve 1606 rotates. In accordance with one embodiment, the detent features can provide for valve adjustment in discrete increments, which can increase or improve the preciseness of the valve control. The detent features can also operate to keep proper valve position during use by preventing undesired change in the valve position. For example, the detent features can limit or prevent rotation of the valve caused by inadvertent contact with knob 1604 and/or operation of the spray gun 102 (i.e., movement of components of spray gun 102, air pressure flowing through spray gun 102, etc.).

Figure 17:
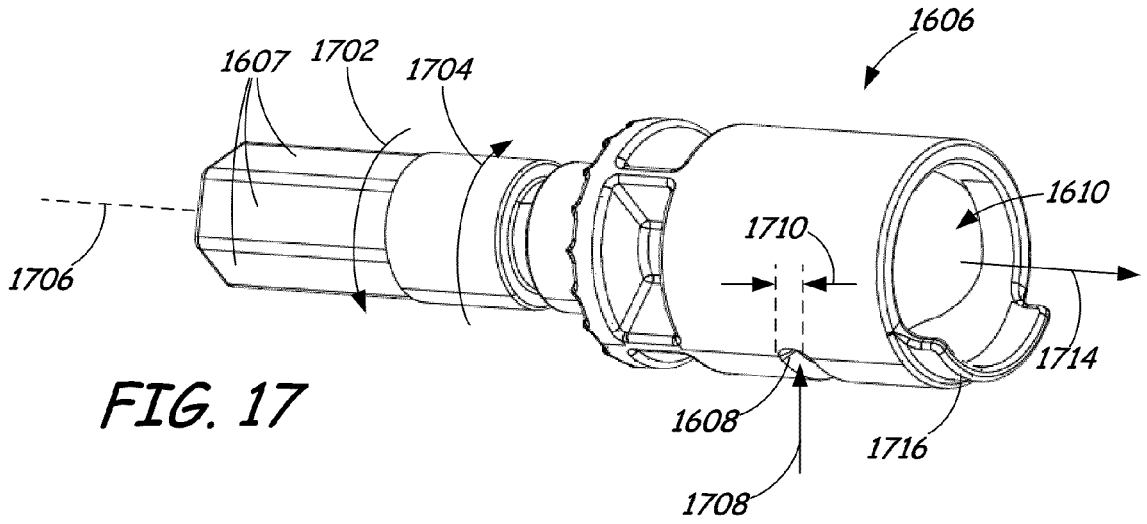
FIGS. 17 and 18 illustrate one embodiment of the airflow control valve illustrated in FIG. 16.
Figure 18:
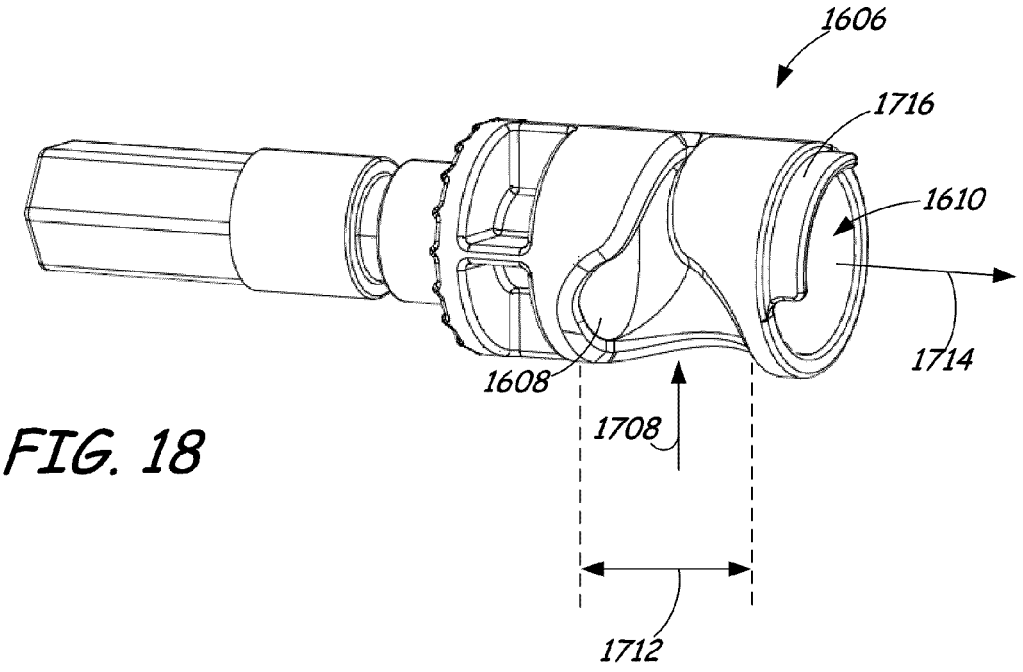

FIGS. 17 and 18 illustrate one embodiment of airflow control valve 1606. As illustrated, surfaces 1607 (that engage inner surfaces 1605 of knob 1604) comprise a plurality of flat surfaces. Valve 1606 is configured to rotate about an axis 1706 in directions illustrated by arrows 1702 and 1704. As the valve 1606 rotates, the dimensions of the portion of the input aperture 1608 that receives the airflow 1708 changes, thus changing the amount of airflow through the valve 1606.

To illustrate, in the exemplary valve position illustrated in FIG. 17 the portion of the input aperture 1608 that receives the airflow 1708 has a width 1710. In the exemplary valve position illustrated in FIG. 18, the portion of the input aperture 1608 that receives the airflow 1708 has a width 1712 (that is illustratively larger than width 1710). Thus, the amount of airflow 1714 from output aperture 1610 is greater in the second valve position illustrated in FIG. 18.

In one embodiment, valve 1606 can include a rotation delimiter 1716 that is configured to engage body 302 of spray gun 102 and define boundaries for rotation of valve 1606.

Figure 19:
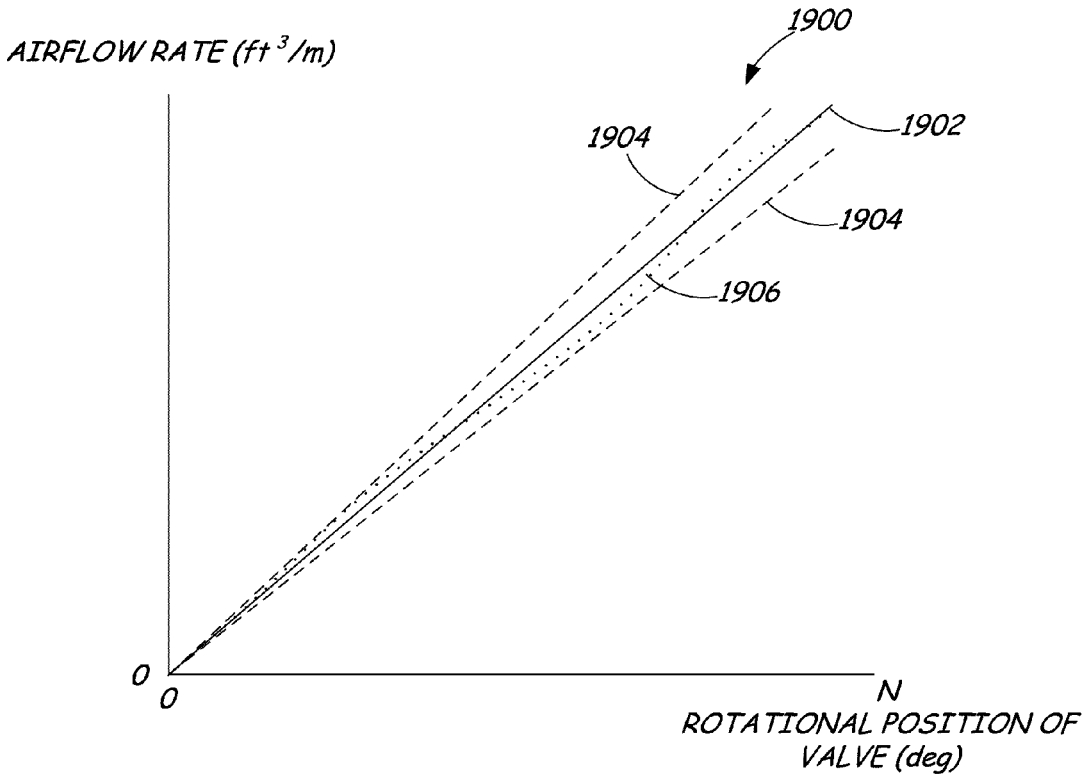
FIG. 19 is a graph illustrating the airflow metering capability of the airflow control valve of FIG. 16, under one embodiment.

In accordance with one embodiment, airflow valve 1606 is configured to provide linear, or substantially linear, airflow metering capabilities. For example, FIG. 19 shows a graph 1900 illustrating an exemplary airflow metering capability of valve 1606. The horizontal axis of graph 1900 represents the rotational position of the valve 1606 (relative to body 302 of spray gun 102). In one embodiment, valve 1606 can be rotated between 0 and N degrees with respect to body 302 based on the rotation delimiter 1716 (illustrated in FIGS. 17 and 18). The vertical axis of graph 1900 represents the rate (in cubic feet per minute) of the airflow 1714 from the output aperture 1610 of the valve 1606 for different rotational positions of valve 1606.

Line 1902 represents one embodiment of the airflow rate through the valve 1606 at different rotational positions. Line 1902 can have any desired slope based on the design of aperture 1608 (e.g., larger or smaller apertures, etc.). In one embodiment, line 1902 is linear and the airflow rate is directly proportional to the rotational position of the valve. In one embodiment, the rate of the airflow 1714 can be a selected function of the angular position of the valve 1606.

In one embodiment, the airflow metering capabilities of the valve 1606 are substantially linear (i.e., linear or almost linear). For example, dashed line 1906 illustrates another embodiment of the airflow rate through the valve 1606 at different rotational positions. Dashed line 1906 is not perfectly linear, but is within a threshold or allowed tolerance (represented by lines 1904) from the linear example (i.e., line 1902). The threshold or allowed tolerance (represented by lines 1904) can comprise, for example, a particular percentage (e.g., 1 percent, 5 percent, 10 percent, etc.) of the airflow rate at each rotation position along the horizontal axis.

The linear, or substantially linear, metering capabilities of the airflow control valve 1606 can be advantageous in applications where precise and accurate airflow control is desired.

Figure 20:
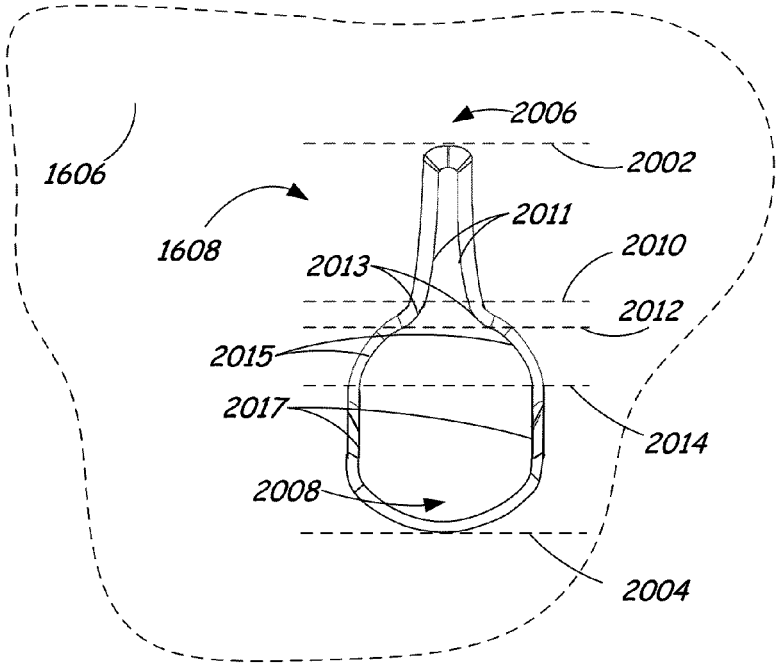
FIG. 20 is a view illustrating a shape of the airflow control valve, under one embodiment.

FIG. 20 illustrates an exemplary structure of input aperture 1608 of valve 1606 for controlling the airflow through spray gun 102. In one embodiment, valve 1606 is rotatable between zero and N degrees (with respect to the body 302). A valve rotation of zero degrees is generally represented by dashed line 2002 and a valve rotation of N degrees is generally represented by dashed line 2004. At a rotation of zero degrees, a portion (generally represented by arrow 2006) of the valve 1606 closes the airflow. At N degrees, the valve 1606 is fully open as a portion (generally represented by arrow 2008) of the aperture 1608 receives the airflow provided from the air source.

Between dashed line 2002 and dashed line 2010, the edges 2011 that form aperture 1608 have a relatively small curvature. Between dashed lines 2010 and 2012, the edges 2013 that form aperture 1608 have a larger curvature as compared to edges 2011. The edges that form aperture 1608 have an inflection point at dashed line 2012. In this manner, the curvature of the edges 2015 between dashed lines 2012 and 2014 is smaller than the curvature of edges 2013. In one embodiment, the edges 2017 that form aperture 1608 comprise straight edges.

Figure 21:
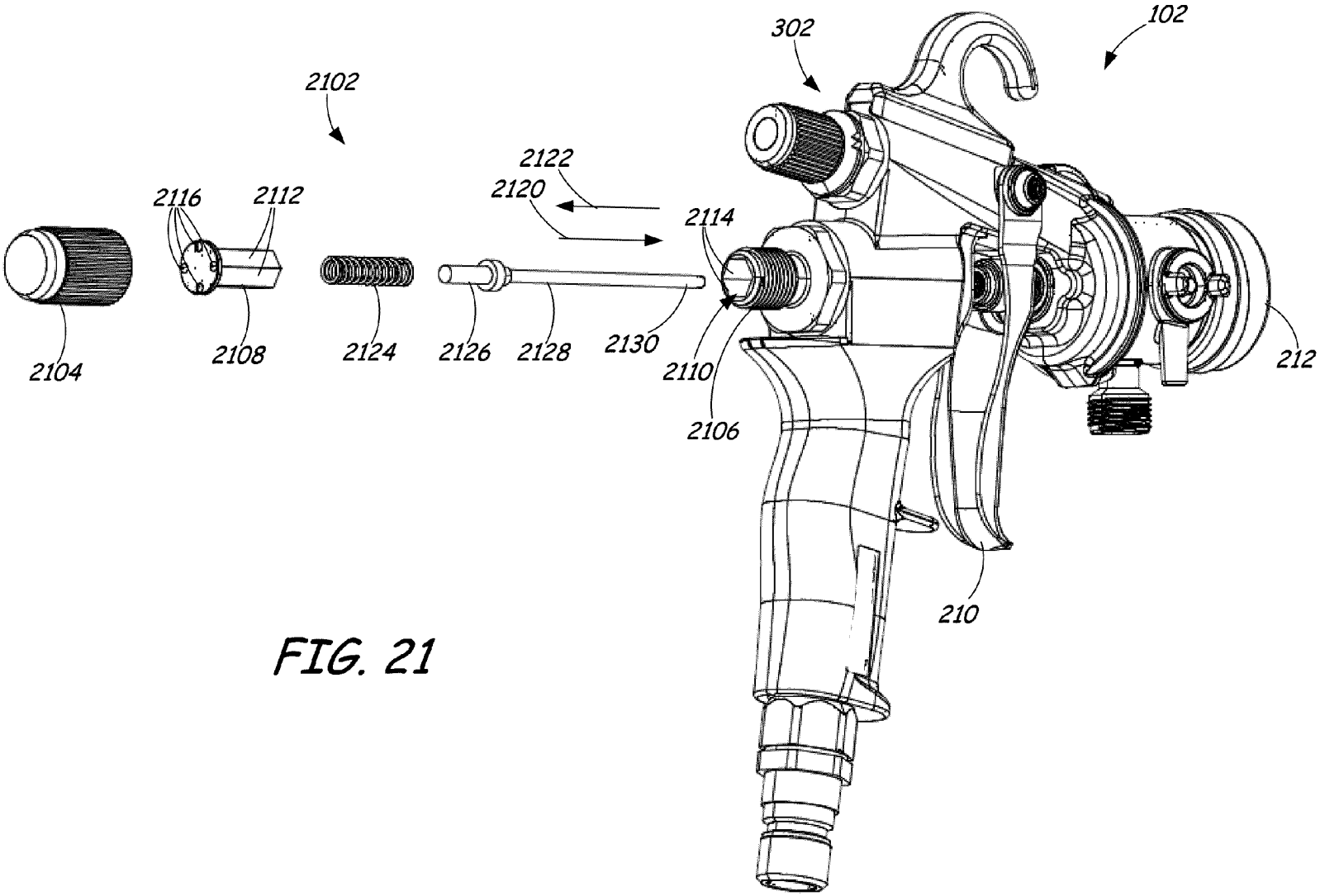
FIG. 21 is a partially exploded perspective view of an exemplary spray gun illustrating a fluid flow control mechanism, under one embodiment.

FIG. 21 is a partially exploded view of spray gun 102 illustrating a fluid control 2102, under one embodiment. Fluid control 2102 is configured to control the maximum amount of flow in the spray pattern from nozzle 212 when trigger 210 is actuated. For example, fluid control 2102 can be configured to limit the maximum distance a needle valve of spray gun 102 can open (e.g., retract from a needle seat). In the embodiment illustrated in FIG. 21, fluid control 2102 includes a knob 2104 threadably engaged to a connection 2106 of body 302. As knob 2104 is threaded onto connection 2106 (i.e., tightened), knob 2104 presses a component 2108 into opening 2110. Likewise, as knob 2104 is unthreaded from connection 2106 (i.e., loosened), component 2108 is able to retract from opening 2110, to some extent. Component 2108 comprises a plunger-like part that includes planar surfaces 2112 configured to engage corresponding planar surfaces 2114 forming in opening 2110. Surfaces 2112 and 2114 prevent rotation of component 2108 with respect to body 302. Fluid control 2102 can also include detent features that are used to mechanically resist rotation of the knob 2104. As illustrated, component 2108 includes a plurality of protrusions or ribs 2116 that are configured to engage knob 2104 (for example, corresponding protrusion in knob 2104. In accordance with one embodiment, the detent features can provide for knob adjustment in discrete increments, which can increase or improve the preciseness of the fluid control. The detent features can also operate to keep proper knob position during use by preventing undesired change in the knob position. For example, the detent features can limit or prevent rotation of the knob caused by inadvertent contact with the knob and/or operation of the spray gun 102 (i.e., movement of components of spray gun 102, air pressure flowing through spray gun 102, etc.).

Movement of plunger component 2108 into or out of opening 2120 causes compression (movement in direction 2120) or expansion (movement in direction 2122) of spring 2124 against a rod 2128. Spring 2124 engages a first end 2126 of rod 2128. A second end 2130 of rod 2128 controls (e.g., restricts, limits) movement of trigger 210 and/or needle 216. For example, movement of rod 2128 can increase or decrease an amount of force applied against trigger 210 and/or needle 216. In this manner, rod 2128 applies a biasing force against trigger 210 and/or needle 216 to control the movement of needle 216 from the nozzle seat, for example.

Figure 22:
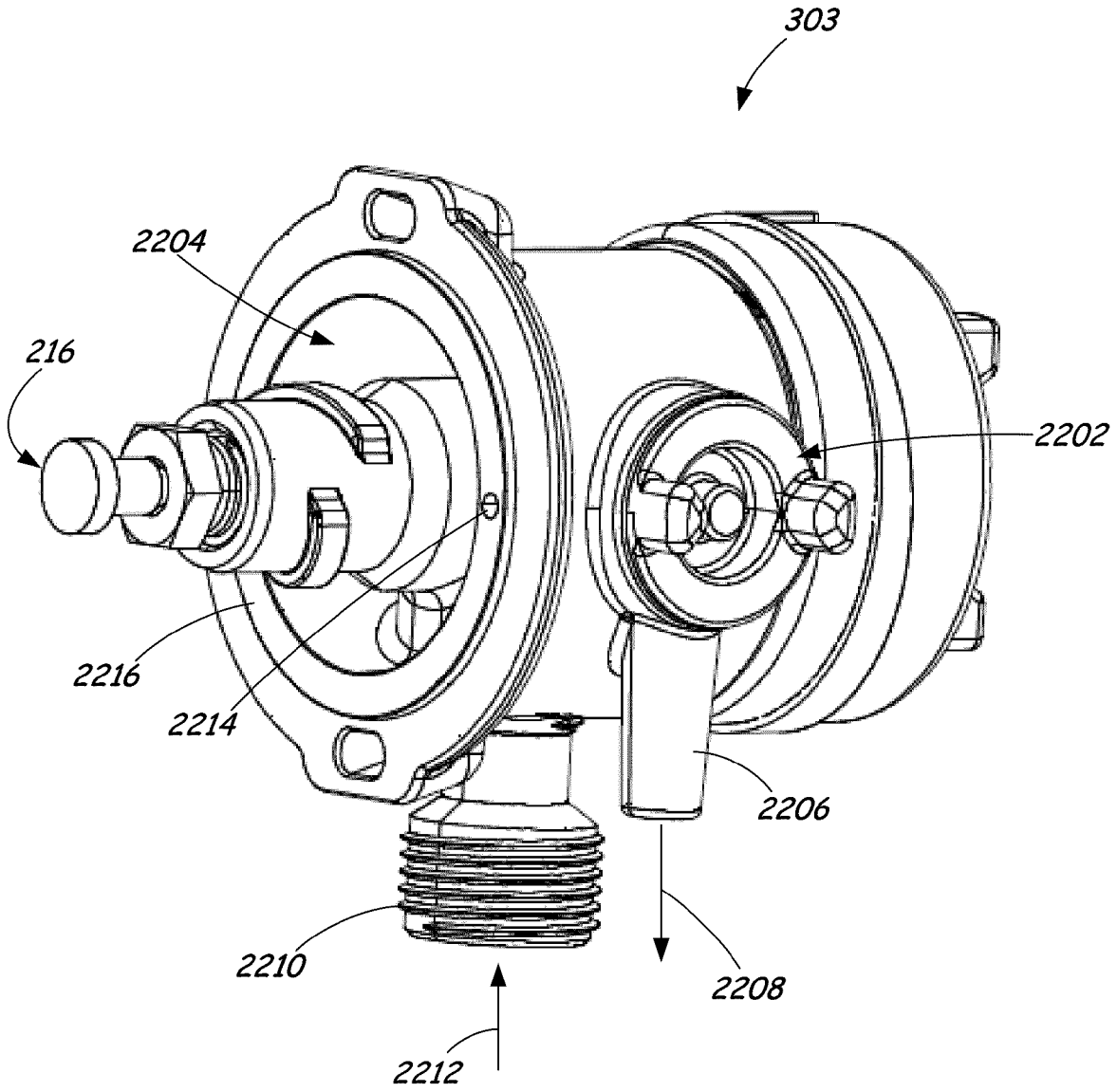
FIGS. 22-24 are perspective views of a spray head, under one embodiment.
Figure 23:
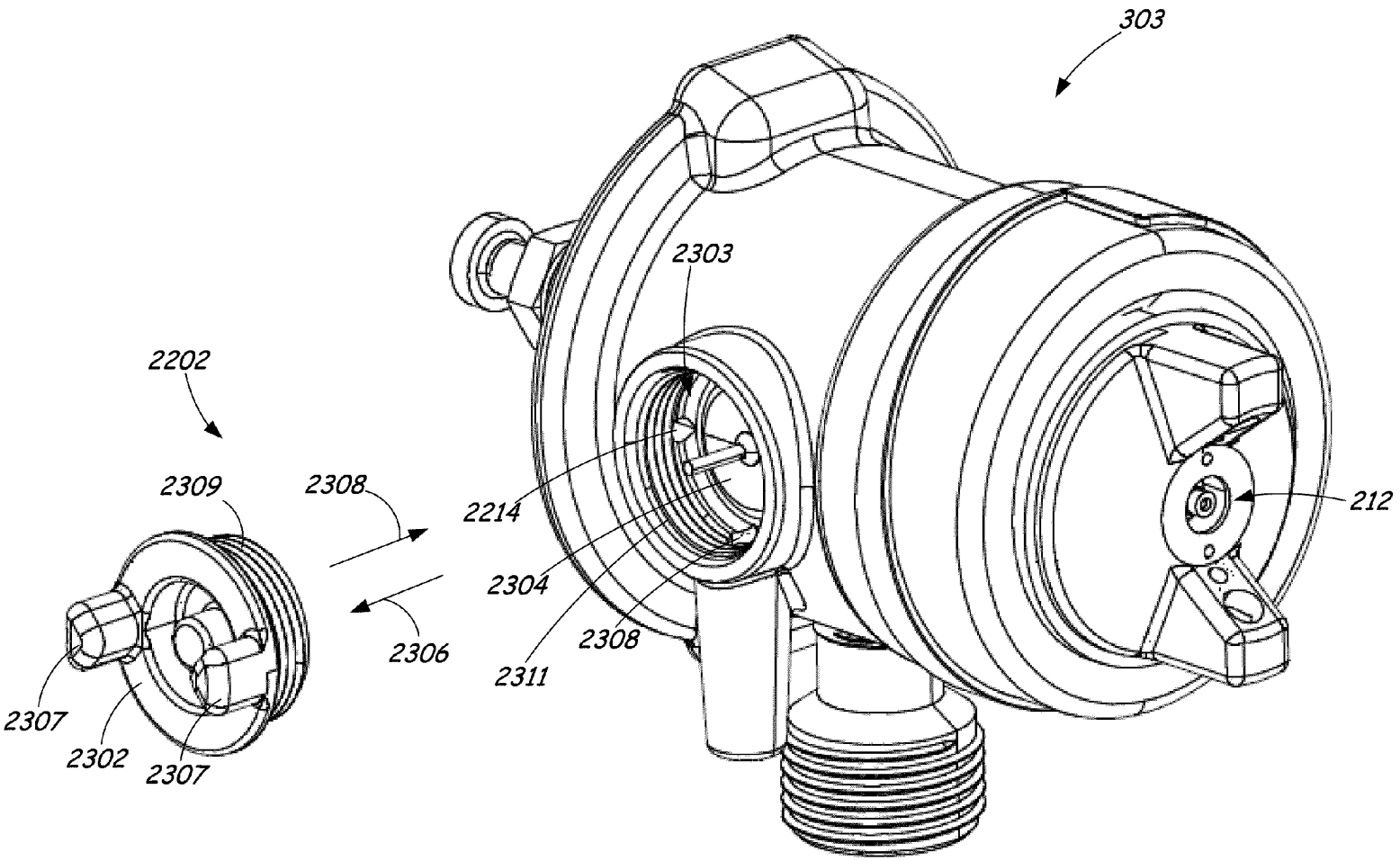
Figure 24:
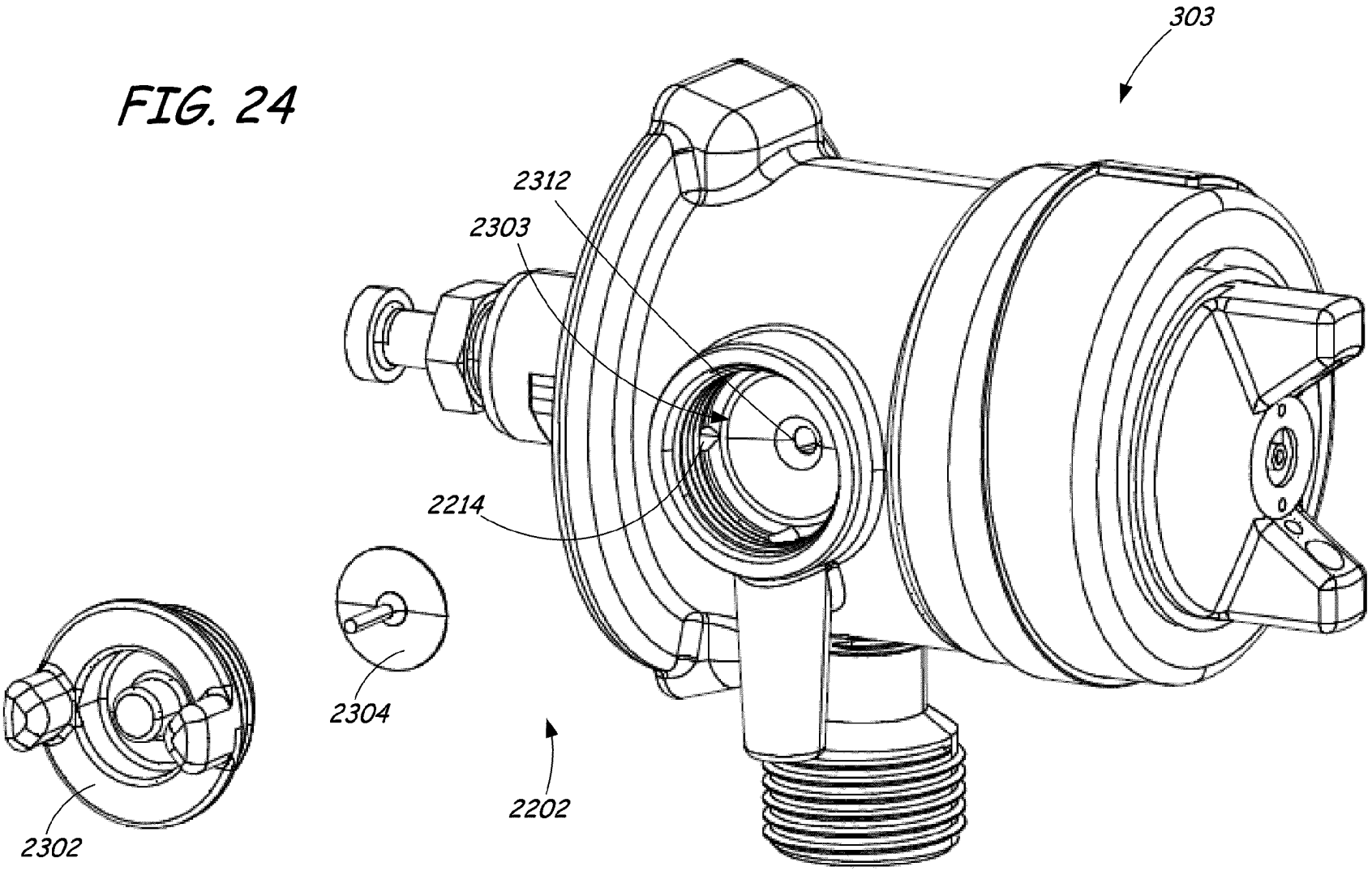
Figure 25:
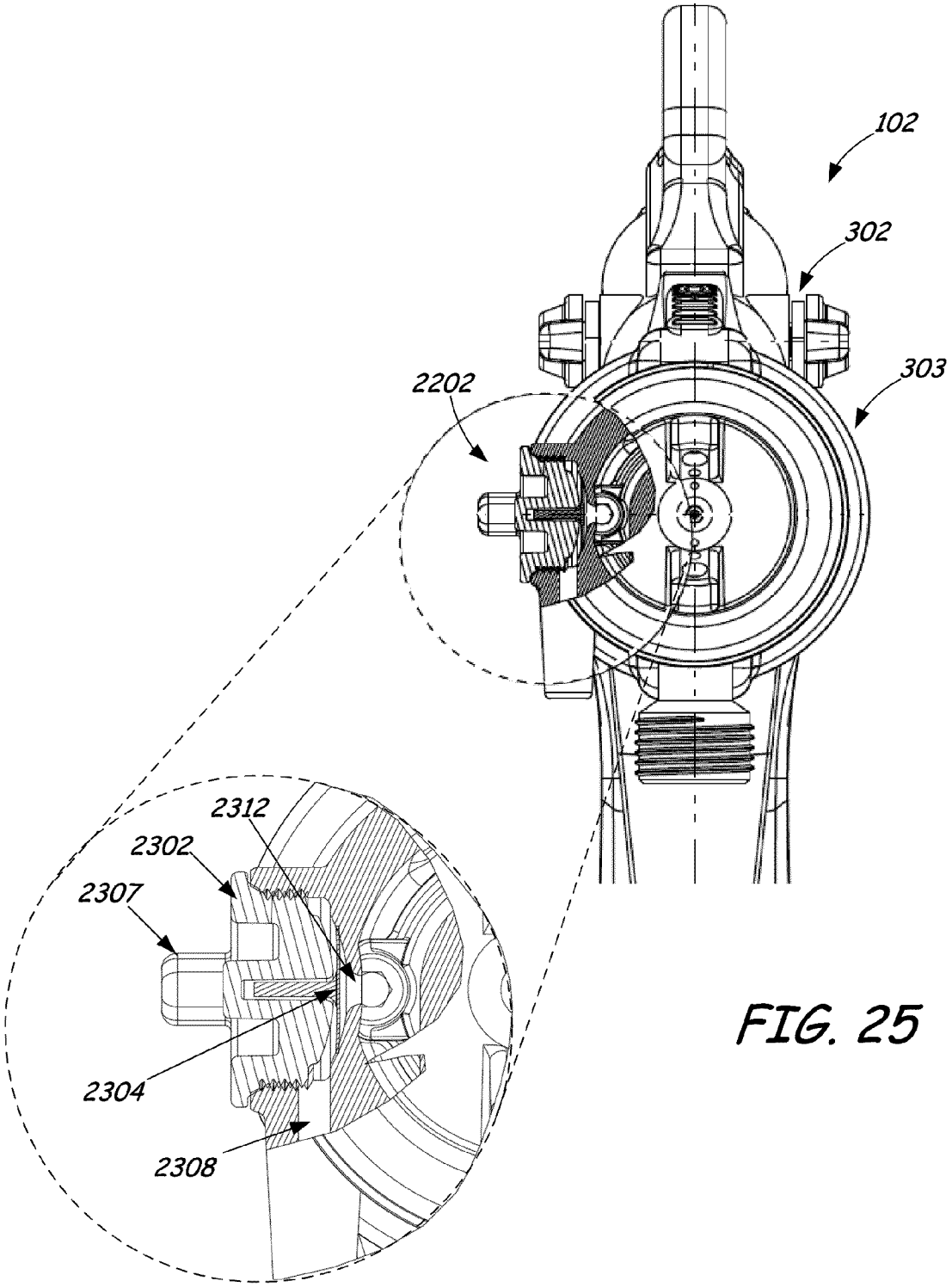
FIG. 25 is a front view of a spray gun illustrating a check valve, under one embodiment.

FIGS. 22-24 are perspective views of spray head 303 illustrating a check valve 2202, under one embodiment. FIG. 25 is a front view of spray head 303, and illustrates spray head 303 attached to body 302 of spray gun 102. FIG. 25 includes a partial cut-away of spray head 303 illustrating a sectional view of check valve 2202.

As illustrated in FIG. 22, pressurized air (i.e., provided from the airflow control valve) enters an internal cavity 2204 of spray head 303. Some of the airflow (e.g., an initial portion of the airflow) is provided from cavity 2204 to a first fluid container connection 2206. The pressurized air is provided by connection 2206 to pressurize the fluid container (not shown in FIGS. 22-24). This is illustrated by arrow 2208. When the needle 216 is opened (i.e., the trigger retracts the needle 216 from the nozzle seat), pressurized fluid from the fluid container is provided to a second fluid container connection 2210. This is illustrated by arrow 2212.

Check valve 2202 allows the pressurized air from cavity 2204 to flow in a first direction through the check valve 2202 into the fluid container (arrow 2208). Check valve 2202 limits or prevents the pressurized air and/or fluid from flowing in a second, opposite direction through the check valve 2202. Thus, check valve 2202 can prevent the air and/or fluid from the fluid container from flowing through the connection 2206 into cavity 2204.

As illustrated in FIGS. 23 and 24, check valve 2202 includes a plug 2302 that is threadably engaged to spray head 303. For example, plug 2302 and spray head 303 can include corresponding threads 2309 and 2311. Further, plug 2302 can include protrusions 2307 that provide surfaces for a user to grasp when threading and unthreading plug 2302 from spray head 303. Plug 2302 retains a check valve seal 2304 in cavity 2303. FIG. 24 shows the check valve seal 2304 removed from the cavity 2303.

In one embodiment, seal 2304 can be biased to a closed position (illustrated in FIG. 25). When pressurized air enters cavity 2204 (i.e., the pressure in cavity 2204 exceeds the pressure in the fluid container), the check valve seal 2304 moves in a first direction 2306, which opens the check valve seal 2304 and allows the pressurized air from the cavity 2204 (i.e., from port 2312 shown in FIG. 24) to pass through a port 2308 into the fluid container. When pressurized air is not being provided to cavity 2204 (i.e., the pressure in the fluid container exceeds the pressure in the cavity 2204), the check valve seal 2304 moves in a second direction 2308, which closes the check valve seal and limits or prevents the pressurized air from the fluid container to pass through port 2312 into cavity 2204. In accordance with one embodiment, spray head 303 includes a bleed port 2214, which provides a path from cavity 2303. When spray head 303 is coupled to body 302, a surface 2216 of spray head 303 forms a seal with a surface of body 302 (for example, surface 320 illustrated in FIG. 3). This engagement between the spray head 303 and the body 302 seals bleed port 2214, preventing air and fluid from flowing from the fluid container through bleed port 2214.

In accordance with one embodiment, the seal on bleed port 2214 is removed when the spray head 303 is rotated and pulled away from the body 302. In other words, bleed port 2214 is configured to bleed pressurized air and/or fluid from the fluid container when the spray head 303 is decoupled from the body 302. In this manner, the pressure in the fluid container is relieved through the bleed port 2214 and does not remain in the fluid container after removal of the spray head 303. Otherwise, if the fluid container remained pressurized after the spray head 303 is decoupled, the pressure in the fluid container would be expelled through the nozzle 212 if the needle valve is opened.

While various embodiments of the invention have been set forth in the foregoing description, together with details of the structure and function of various embodiments of the disclosure, this disclosure is illustrative only, and changes may be made in detail, especially in matters of structure and arrangement of parts within the principles of the present disclosure to the full extent indicated by the broad general meaning of the terms in which the appended claims are expressed. For example, the particular elements may vary depending on the particular application for the system or method while maintaining substantially the same functionality without departing from the scope and spirit of the present disclosure and/or the appended claims.

What is claimed:

1. A fluid sprayer comprising:

a main body having a handle and a trigger;

a spray head having a fluid input for receiving fluid material and a fluid output for spraying the fluid material using pressurized air to atomize the fluid material, wherein the spray head is removably couplable to the main body;

a needle valve having a needle that is positioned at least partially within the spray head and configured to be actuated by the trigger of the main body between a closed position that restricts release of fluid material from the fluid output and an open position that allows release of fluid material from the fluid output, wherein the needle is configured to be removed from the main body and remain disposed within the spray head in the closed position when the spray head is separated from the main body;

wherein the spray head further comprises a first container connection providing a flow of air to a fluid container along an air flow path to pressurize fluid in the fluid container;

an airflow control mechanism having a rotatable knob configured to open and close the air flow path;

a valve mechanism positioned along the air flow path, the valve mechanism being configured to allow flow in a first direction to the fluid container and prevent flow in a second direction from the fluid container;

a second container connection forming the fluid input for receiving the pressurized fluid from the fluid container along a fluid flow path; and a bleed port fluidically coupled to the air flow path between the fluid container and the valve mechanism, the bleed port configured to release pressure from the fluid container when the spray head is separated from the main body.

2. The sprayer of claim 1, further comprising a mechanism configured to selectively disengage the trigger from the needle allowing the needle to be removed from the main body.

3. The sprayer of claim 1. wherein the valve mechanism comprises a check valve.

* * * * *